US005927093A

United States Patent [19]

Noguchi et al.

[11] Patent Number: 5,927,093

[45] Date of Patent: Jul. 27, 1999

[54] REFRIGERANT DISTRIBUTION UNIT FOR AIR-CONDITIONERS

[75] Inventors: Hiroshi Noguchi, Kiryushi; Hiroyuki Iijima, Ora-machi; Kiyoshi Kobayashi, Ashikagashi, all of Japan

[73] Assignee: Sanyo Electric Co., Ltd., Gunma, Japan

[21] Appl. No.: 09/030,017

[22] Filed: Feb. 25, 1998

[30] Foreign Application Priority Data

Feb. 28, 1997 [JP] Japan ..... 9-060189
Apr. 2, 1997 [JP] Japan ..... 9-097937

[51] Int. Cl.[6] ..... F25D 17/08

[52] U.S. Cl. ..... 62/259.1; 62/504; 62/525

[58] Field of Search ..... 62/504, 525, 298

[56] References Cited

U.S. PATENT DOCUMENTS 5,074,120 12/1991 Kitamoto ..... 62/156
5,272,885 12/1993 Watanabe ..... 62/184
5,297,396 3/1994 Kitamoto ..... 62/175
5,317,907 6/1994 Shimizu et al. ..... 62/176
5,323,617 6/1994 Ichikawa ..... 62/129
5,794,452 8/1998 Black et al. ..... 62/73

*Primary Examiner*—Henry Bennett
*Assistant Examiner*—Mark Shulman
*Attorney, Agent, or Firm*—Armstrong, Westerman, Hattori, McLeland & Naughton

[57] ABSTRACT

A refrigerant distribution unit 10 is an integrated structure comprising: a multiplicity of branch tubes 12*a*–12*c* connectable with a multiplicity of indoor units 1*a*–1*c*; a distributor 11, connected with one refrigerant tube 5*a* extending from an outdoor unit for receiving refrigerant from the outdoor unit, the distributor distributing the refrigerant to the multiple branch tubes 12*a*–12*c;* and electric valves 15 provided one in each of the branch tubes 12*a*–12*c* for controlling the flows of refrigerant that pass through the respective branch tubes; and a case for enclosing the flow control unit. The refrigerant distribution unit 10 enables distribution of optimal amounts of refrigerant to all of the coexisting indoor units 1*a*–1*e,* even when the indoor units 1*d*–1*e* have much larger heat capacities than the indoor units 1*a*–1*c*.

11 Claims, 21 Drawing Sheets

REFRIGERANT DISTRIBUTION UNIT FOR AIR-CONDITIONERS

FIELD OF THE INVENTION

The present invention relates generally to a multiplex air-conditioning system having a single outdoor unit and capable of controlling the flows of the refrigerant from the outdoor unit to a multiplicity of indoor units installed in individual rooms of a building. More particularly, the invention relates to a distributor suitable for distributing optimal amounts of refrigerant from such single outdoor unit to each of the indoor units as required.

BACKGROUND OF THE INVENTION

In a typical separate type air-conditioner, an outdoor unit is connected with an indoor unit and has an air conditioning capacity appropriate for the rooms in which the indoor unit is installed.

This implies that the same number of indoor and outdoor units must be set up if all the rooms are air-conditioned with this type of air conditioning system, which is very costly and requires a great amount of installation work. As a solution to this problem, a multiplex air-conditioning system has been proposed, in which a multiplicity of indoor units are connected with a single outdoor unit having a large capacity.

If, however, each of such indoor units are connected independently of each other with the outdoor unit via a pair of tubes for the circulation of the refrigerant, the total length of the refrigerant tubes will be disadvantageously large, since each of the indoor units must be connected with the outdoor unit by an independent pair of refrigerant tubes. As a consequence of such tubing, an appreciable pressure drop will result in the tubes and hence the outdoor unit must have a large cooling capacity to compensate the pressure drop. In addition, the outdoor unit must have a complex tubing unit for connecting many refrigerant tubes. This also causes a problem of complex tubing and an extra cost.

Recent development in architectural technology has enabled construction of a building which is thermally well insulated, with rooms having good insulation. This is advantageous for a contemporary house for a family having individual small rooms rather than having a fewer but larger traditional rooms. In this case it is not economical both from points of running cost and construction cost to set up an independent air conditioning unit for each room, since individual rooms do not need a large air conditioning capacity. It would be advantageous to install a multiplex air conditioning system in air-conditioning a group of such well insulated small rooms if the air-conditioning system can be so controlled as to provide refrigerant to these indoor units as needed, because most of these indoor units require only a small amount of refrigerant. Unfortunately, however, conventional multiplex air-conditioning systems are normally designed to distribute refrigerant evenly to all indoor units connected, and are not capable of controlling the flows to the individual indoor units, so that a large indoor unit, if present, cannot obtain sufficient refrigerant.

SUMMARY OF THE INVENTION

To overcome the limitations in the prior art described above, the present invention provides a refrigerant distribution unit for use with a multiplex air-conditioning system, which enables the air-conditioning system to provide an optimum amount of refrigerant received from a single outdoor unit to each of the indoor units having different capacities.

In accordance with one aspect of the present invention, there is provided a refrigerant distribution unit comprising means, connected with an outdoor unit via a refrigeration tube and receiving the refrigerant from the outdoor unit, for distributing optimal amounts of refrigerant to a multiplicity of channels connected with the indoor units.

With this refrigerant distribution unit, a multiplicity of small indoor units may be connected with an outdoor unit, while a large indoor unit may be connected directly with the outdoor unit, so that optimum amounts of refrigerant are distributed to each of the large and small indoor units.

The refrigerant distribution unit may be advantageously installed at a flat place inside a building where the refrigerant tube extending from the outdoor unit is divided into multiple tubes for the indoor units. In this case, the refrigerant is less affected by gravity, thereby permitting desirable circulation of the refrigerant through the air-conditioning system. In addition, the refrigerant distribution unit is maintained under a fairly stable environmental condition compared with a case where the refrigerant distribution unit is installed outside the building.

The refrigerant distribution unit is preferably positioned closer to the indoor units than to the outdoor unit so that the total length of refrigerant tubes is minimized.

The refrigerant distribution unit is preferably located at a position separated at an equal distance from the indoor units, so that the pressure drops are the same in the refrigerant tubes leading to the indoor units. This makes it easy to control the flow of the refrigerant to the indoor units.

In accordance with another aspect of the invention, there is provided an integral refrigerant distribution unit comprising a fluid control unit which includes a distributor installed at a flat place inside a building and connected with one refrigerant tube extending from an outdoor unit, the distributor distributing the refrigerant to multiple channels; a multiplicity of branch tubes each connected at one end thereof with one of the channels of the distributor and connected at the other end thereof with an indoor unit; and electric expansion valves provided one in each of the branch tubes for controlling the flows of refrigerant that pass through said multiplicity of branch tubes, and a case for enclosing the flow control unit.

With this refrigerant distribution unit, the amount of the refrigerant supplied to each indoor unit may be easily and reliably controlled.

The case of the refrigerant distribution unit includes a metal box and a lid in the form of metal sheet so as to provide the refrigerant distribution unit in an integrated structure. The refrigerant distribution unit is embedded in a heat insulator made of a foamed or expanded resin so that the unit is firmly kept in position in the case and protected by the resin. The case may also prevent the unit from getting wet by the dew due to condensation of moisture in the air that would otherwise take place on the chilled refrigerant tubes when the unit is installed inside a building. Thus, no draining conduit for removing the dew is needed, and accordingly the refrigerant distribution unit may be greatly simplified in structure and set up in the building easily.

The case may be provided with an opening for exposing a section of the heat insulator so that an electric circuit board may be directly mounted on that section of the unit. This permits of good electrical insulation of the electric circuit board from the unit without any conventional electric insulator or plastic legs to keep the electric circuit board insulated.

The heat insulator may be an expanded polyurethane obtained from a mixture of polyol and isocyanate in the ratio of 50:50 weight percent. This material is desirable because it is not only durable but also inflammable, and can prevent a fire accident associated with the refrigerant distribution unit to take place, so that it adds safety and durability to the unit.

The case may be provided with an opening for injecting the mixture of foamable material such that the direction of the injection coincides with the direction in which an electric coil of the electric expansion valve is fitted on the valve. In this case, the expansion force of the heat insulator helps to secure the electromagnetic coil in position, thereby further increasing the durability and reliability of the unit.

In accordance with still another aspect of the invention, there is provided a refrigerant distribution unit comprising:

a fluid control unit connected with an outdoor unit via a refrigeration tube for receiving refrigerant from the outdoor unit and for distributing optimal amounts of refrigerant to a multiplicity of branch tubes connected with the indoor units; and a case made up of two metallic members for enclosing a major portion of the flow control unit, wherein the major portion of the flow control unit is enclosed in the case in the following steps of:

(a) setting up the flow control unit in an expansion jig having the same internal space as that of the case;

(b) injecting a foamable resin in the expansion jig and expanding the resin to fill the space;

(c) mounting, on one of the casing members independently of steps (a) and (b) above, necessary electric components for controlling the flow control unit; and (d) mounting the one casing member obtained in step (c) and the other casing member on the major portion of the flow control unit fabricated in step (b).

In manufacturing this type of refrigerant distribution unit, the electric control panel may be mounted on one of the two casing members while the flow control unit is seated in the coupled casing members and the foamable material is injected for expansion. These two processes may be carried out simultaneously. A complete refrigerant distribution unit is obtained by simply fitting the urethane-molded flow control unit in the metallic casing members. Thus, one needs not withhold mounting the electric components on the case until the foaming material is fully expanded and solidified in the case. This adds extra efficiency to manufacture of the refrigerant distribution unit. It should be noted that, instead of mounting the electric components on a heavy case accommodating therein the entire flow control unit, the components may be easily mounted on a light casing member. This greatly helps to reduce the amount of assembly work and production of defective units.

DETAILED DESCRIPTION OF THE PREFERRED EMBODIMENT

Figure 1:
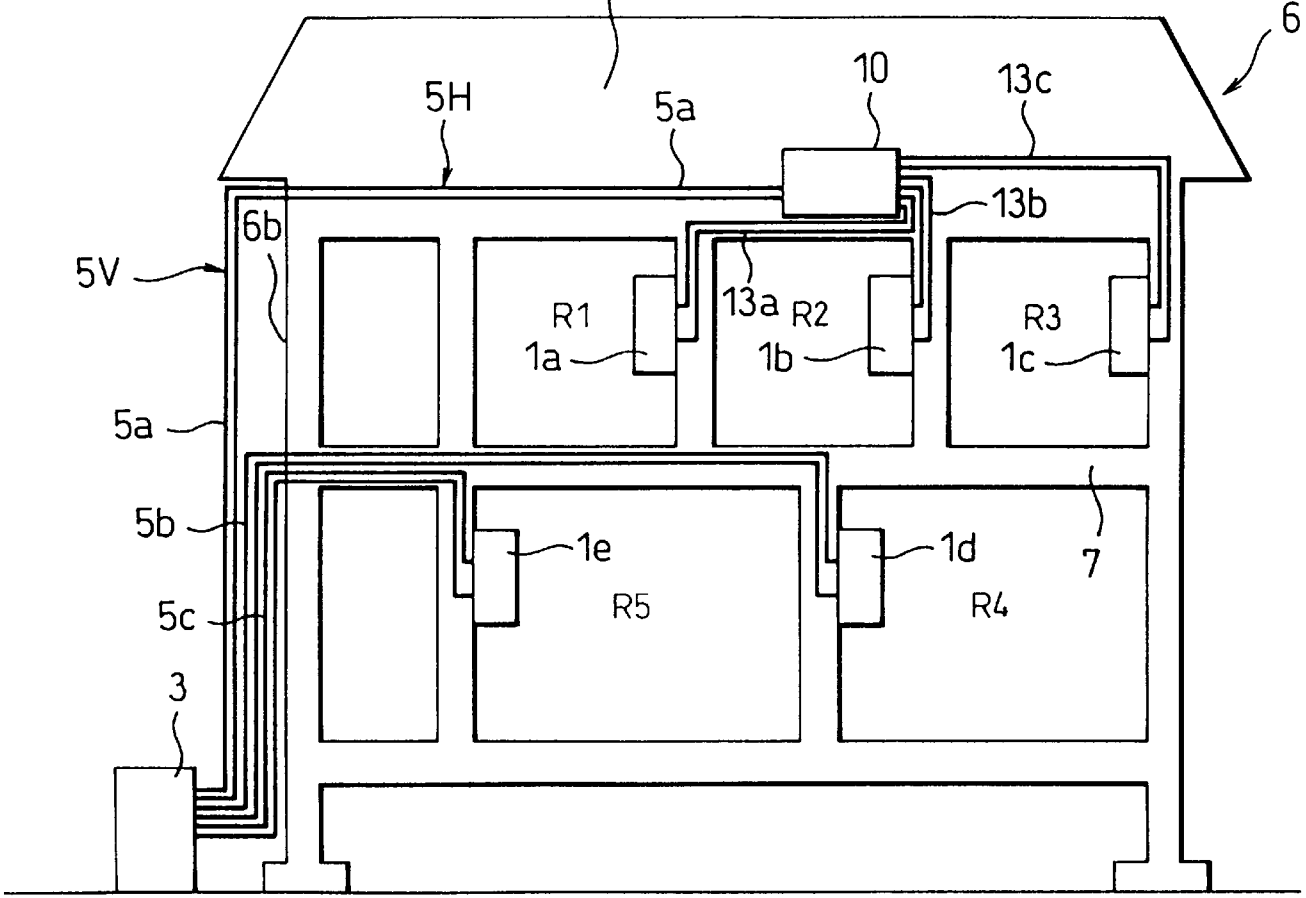
FIG. 1 is a schematic view of an air-conditioning system according to the invention.

FIG. 1 illustrates an air-conditioning system which utilizes a refrigerant distribution unit of the invention in air-conditioning a multiplicity of rooms on the first and the second floors of a two-storied building 6.

As shown in the figure, rooms R1–R5 are equipped with indoor units 1*a*–1*e*, respectively, installed on the respective walls for example. Each of the indoor units 1*a*–1*e* has a heat exchanger and a blower. In the example shown herein the rooms R1, R2, and R3 are smaller than the rooms R4 and R5, so that the indoor units 1*a*, 1*b*, and 1*c* are smaller than the indoor units 1*d* and 1*e* for the rooms R4 and R5. By a smaller indoor unit, we mean that it has a smaller heat capacity and that the amount of the refrigerant to be passed through the heat exchanger of the unit is smaller. The indoor units of the rooms on the first floor are equipped with larger indoor units that require larger refrigerant flows.

An outdoor unit 3 is set up outside the building. The outdoor unit has such elements as a compressor, a heat exchanger, a capillary tube, a blower, and an expansion means such as an electric expansion valve, for example.

In order to distribute refrigerant fed from the outdoor unit 3 evenly to the indoor units, refrigerant tubes 5*a*, 5*b*, and 5*c* are connected with the outdoor unit 3. These tubes are lead to the exterior wall 6*b* of the building. The tubes, 5*b* and 5*c*, are extended on the upright wall 6*b* and lead into a space 7 between the second floor and the ceiling of the rooms R4 and R5 on the first floor, and connected with the indoor units 1*d* and 1*e*, respectively.

On the other hand, the tube 5*a*, which is designed to allow a maximum flow of refrigerant which equals the sum of flows through the two tubes 5*a* and 5*b*, is lead to the roof level and into the attic 8. Mounded in the attic 8 and connected at the end of the tube 5*a* is a refrigerant distribution unit 10 of the invention so that substantially equal amounts of the refrigerant are supplied to the three indoor units 1*a*, 1*b*, and 1*c* in the rooms R1–R3 on the second floor.

Figure 2:
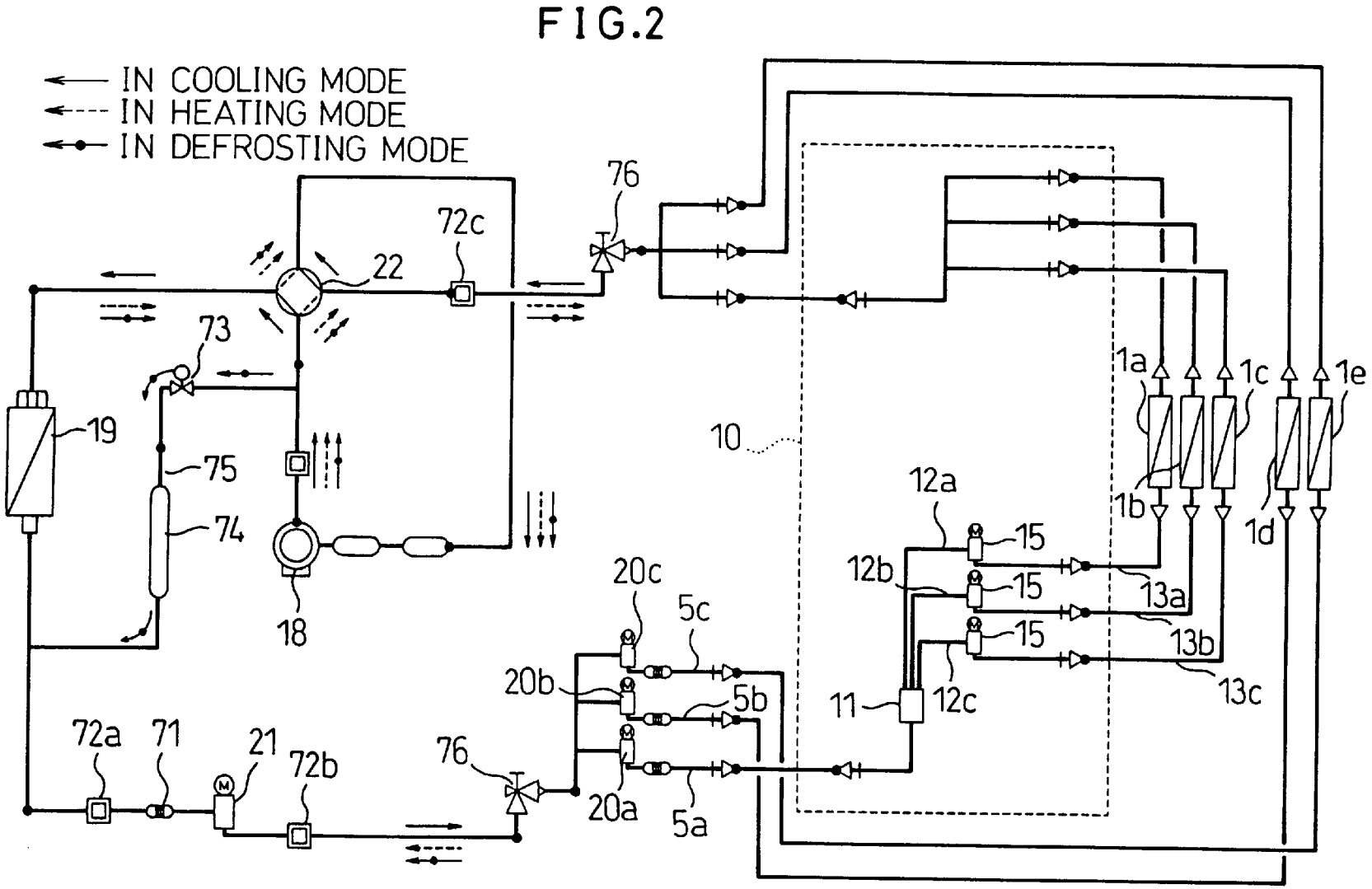
FIG. 2 is a diagram illustrating a refrigerant circuit of the air-conditioning system according to the invention.

FIG. 2 illustrates further details of the refrigerant circuit of the air-conditioning system of FIG. 1, showing how the refrigerant distribution unit 10 of the invention is utilized in the air-conditioning system. In addition to the five indoor units 1*a*–1*e*, the air-conditioning system includes the following elements in the outdoor unit 3:

- a compressor 18 for compressing the refrigerant;
- a heat exchanger 19 (hereinafter also referred to as outdoor heat exchanger) for exchanging heat between the refrigerant and the atmosphere;
- an electric expansion valve 21 serving as an expansion means;
- a four-way valve 22 for switching the passages of the refrigerant for cooling/heating the rooms.

The outdoor unit has three refrigerant tubes 5*a*–5*c* available for the indoor units 1*a*–1*e*. In this example the indoor units are connected with the tubes 5*a*–5*c* via the refrigerant distribution unit 10 connected with the tube 5*a* and connection tubes 13*a*–13*c*. Electric expansion valves 20*a*–20*c*, are also provided in the tubes 5*a*–5*c*, respectively.

The refrigerant circuit also includes a strainer 71, three mufflers 72*a*–72*c*, as well as a defrosting circuit 75 consisting of a defrosting valve 73 and a receiver tank 74 for permitting the passage of hot gaseous refrigerant to pass through the outdoor heat exchanger 19 and the indoor units 1*a*–1*e* during a defrosting mode of operation. It would be noted that the outdoor and indoor units may be connected and disconnected by means of two service valves 76.

In a cooling mode, the four-way valve 22 is set to circulate the refrigerant in the refrigerant circuit in the direction indicated by solid arrows, while in a heating mode the four-way valve is switched to circulate the refrigerant in the direction indicated by broken arrows. In a defrosting mode the refrigerant is circulated through a path as indicated by arrows having central dots.

The refrigerant distribution unit 10 includes:

a distributor 11 which is connected with the tube 5*a* extending from the outdoor unit 3 for receiving the refrigerant and for distributing the refrigerant to three branch tubes 12*a*–12*c* which are connected with three indoor units 1*a*–1*c* via the connection tubes 13*a*–13*c*.

Three electric valves 15 mounted in the respective branch tubes 12*a*–12*c* for controlling the flows of the refrigerant therethrough so as to provide optimal amount of refrigerant to the three indoor units 1*a*–1*c* on the second floor. These elements may be installed in the attic 8.

The refrigerant line 5*a* has a vertical section 5V running on the external wall 6*b* of the building 6, and a horizontal section 5H which is perpendicularly connected with the vertical section 5V and runs horizontally in the attic 8. It should be noted that the refrigerant distribution unit 10 is connected with the horizontal section 5H rather than with the vertical section 5V, so that gravitational effect on the flow of the refrigerant through the refrigerant distribution unit 10 is avoided. In this arrangement, only two tubes suffice for the vertical section 5V, as compared with six tubes in conventional arrangement, thus minimizing the total length of the refrigerant tubes, especially the length of the vertical tubes where the circulating refrigerant is affected by gravity. In other words, distribution of the refrigerant is carried out in the horizontal section in the building where the circulation of the refrigerant is not affected by gravity, so that pressure loss which would otherwise takes place in the vertical sections is greatly reduced, thereby permitting the use of a small outdoor unit.

It should be also noted that the refrigerant distribution unit 10 is preferably positioned closer to the indoor units than to the outdoor heat exchanger. For example, supposing that the distance between the outdoor heat exchanger 3 and an indoor unit is L, the refrigerant distribution unit 10 is preferably placed near the indoor unit at a distance less than L/2 from the indoor unit.

In addition, the refrigerant distribution unit 10 is preferably positioned at a substantially equal distance from the indoor units 1*a*–1*c*. Arranged in this manner, the total length of the tubes is further minimized, permitting an efficient use of tubing and reduction of installation work as well as cost.

Figure 3A:
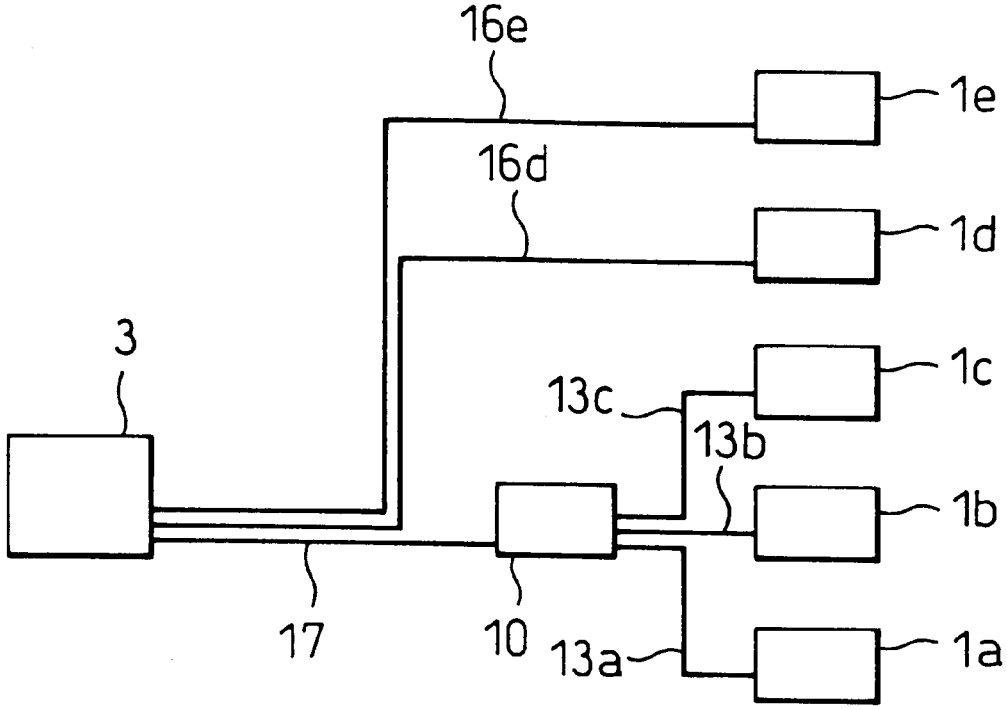
FIG. 3(*a*) compares tubing in a schematic view of the refrigerant circuit of the air-conditioning system according to the invention, with that of a conventional air-conditioning system shown in FIG. 3(*b*), the comparison showing a merit of the invention.
Figure 3B:
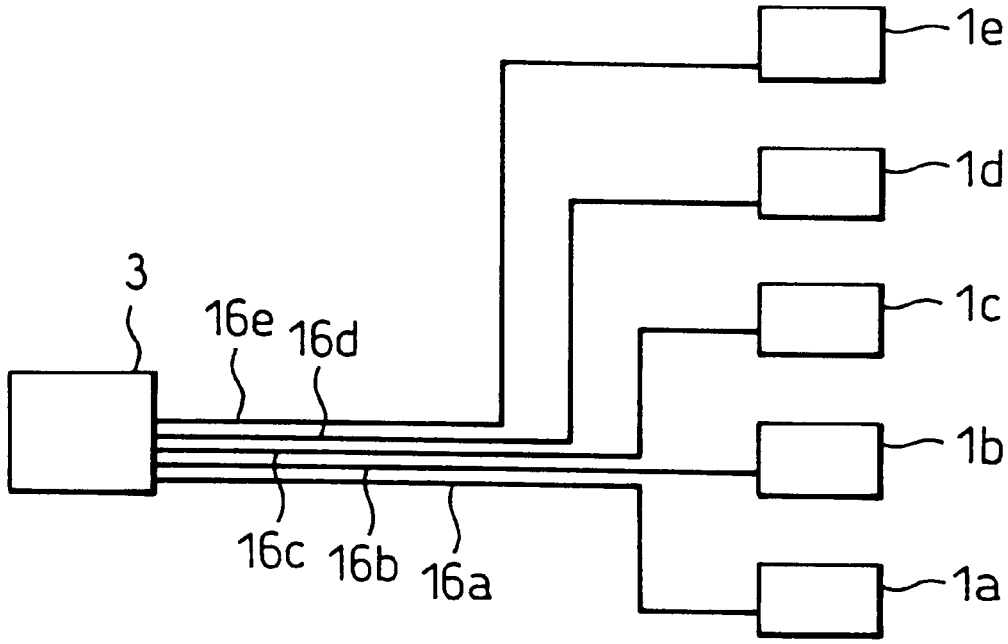

The merit of the invention may be appreciated in an example depicted in FIG. 3. FIG. 3(A) shows a general arrangement of an air-conditioning system according to the invention, and FIG. 3(B) that of a conventional air conditioning system. Both systems uses a single outdoor unit 3 for five indoor units 1*a*–1*e*. It is seen in FIG. 3(B) that the conventional system is provided with five lines or pairs 16*a*16*e* of refrigerant tubes one line for each of the five indoor units in the rooms R1–R5.

Suppose that the distances between the outdoor unit 3 and two indoor units 1*d* and 1*e* are 10 meters, and the distances between the outdoor unit 3 and the three indoor units are 20 meters. Then the total length of the tubes amounts to (10×2)×2 m or 40 m for the two indoor units plus (20×2)×3 m or 120 m for the three indoor units.

The number of the tubes required between the outdoor unit and the indoor units is as many as 10. It is obvious that the tubing of so many tubes is involved and requires a complex tube arrangement.

Compared to the conventional system, the one according to the invention is much simpler in structure, as shown in FIG. 3(A), in which the three indoor units 1*a*–1*c* needs only one pair of tubes 17 for connection with the outdoor unit 3.

In addition, by locating the refrigerant distribution unit 10 close to the indoor units 1*a*–*c*, the lengths of the tubes between these indoor units and the refrigerant distribution unit 10 are further reduced.

For example, given the same arrangement of the indoor units as in the conventional system, so that the length of the tube between the outdoor unit and the two indoor units 1*a* and 1*b* is also 40 m, if the refrigerant distribution unit 10 is positioned 15 m away from the outdoor unit, then the refrigerant distribution unit 10 may be connected with the three indoor units 1*a*–1*c* by 5 m long connection tubes 13*a*–13*c*. In this case, the total length of the tubes between the refrigerant distribution unit 10 and the three indoor units is (5×2)×3 m or 30 m, so that the overall tube length is 60 m, which is shorter than the corresponding conventional tube length by as much as 60 m. The invention thus contributes to simplification of tubing, and hence of maintenance and tubing cost, as well as reduction of required heat capacity of the outdoor unit.

Referring now to FIGS. 4 through 9, there is shown a detailed structure of the refrigerant distribution unit 10 according to the invention. The refrigerant distribution unit 10 has: a paired line of connection tubes 30 (consisting of tubes of a large and a small diameters); a distributor 11 connected with the small-diameter tube 30; three lines of paired refrigeration tubes (hereinafter referred to as branch tubes) 12*a*–12*c* with each line consisting of a large and a small diameter tubes branching or separating from the line 30 in such a way that the large and small diameter tubes of the branch tubes separate from the large and small diameter tubes 30, respectively; and three electric expansion valves 15 are provided, one for each of the three small-diameter branch tubes 12*a*–12*c* for controlling the flows through the branch tubes. These elements together constitute a flow control unit 31. A major portion of the flow control unit, that is, the distributor 11, the electric expansion valves 15, and part of the branch tubes 12*a*–12*c* and the connection tubes 30, are enclosed in a metallic case 36 (FIGS. 4 and 9), and molded with a resin as described below.

Figure 4:
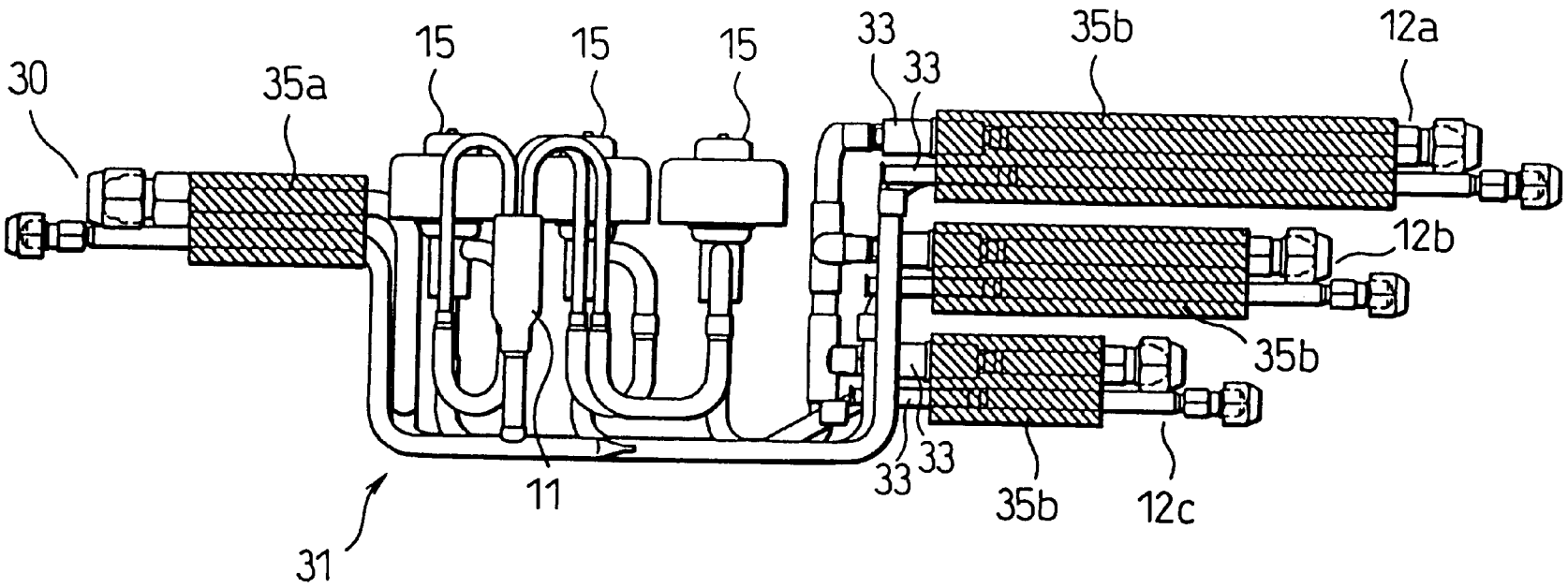
FIG. 4 is a schematic view of a major portion of a flow control unit according to the invention.

The three lines of paired branch tubes 12*a*–12*c* are connected with the indoor units 1*a*–1*c*, respectively, via connection tubes 13*a*–13*c* as shown in FIG. 2. Each of the large- and small-diameter branch tubes 12*a*–12*c* are provided near the branching sections thereof with a temperature sensor 33, such as thermistor, for measuring the temperature of the refrigerant that flows in the tube to and from the corresponding indoor unit, as shown in FIG. 4. Signals obtained from the sensors 33 may be utilized to control the electric expansion valves 15 so as to provide optimal flows in the respective indoor units. The electric expansion valves 15 may be actuated by stepping motors, for example.

Figure 8:
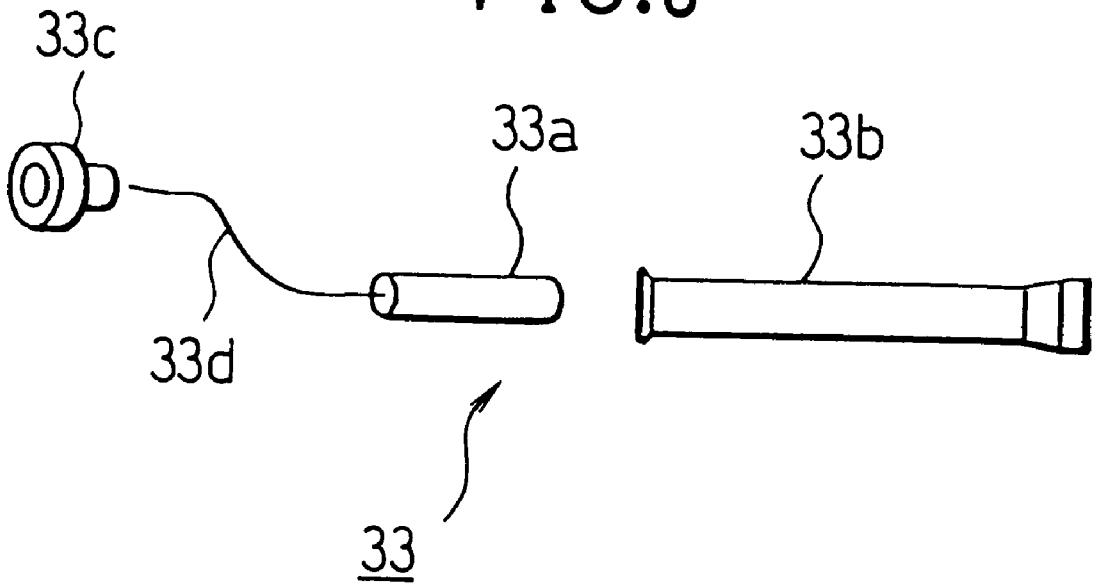
FIG. 8 is a view illustrating how a sensor is mounted on a refrigerant tube for sensing the temperature of the refrigerant through the tube and providing the temperature information to the electric expansion valve.

FIG. 8 shows details of such a temperature sensor 33. The sensor 33 has a main body 33*a* seating in a tubular case 33*b* and sealed by a cap 33*c*. Signals indicative of the temperature of the refrigerant are taken out by a lead wire 33*d* penetrating the cap 33*c*. In order to obtain accurate temperature reading of the branch tubes 12*a*–12*c*, all the sensors 33 are soldered on the respective branch tubes 12*a*–12*c* and covered with a heat insulator 35*b* (FIG. 4).

Figure 6:
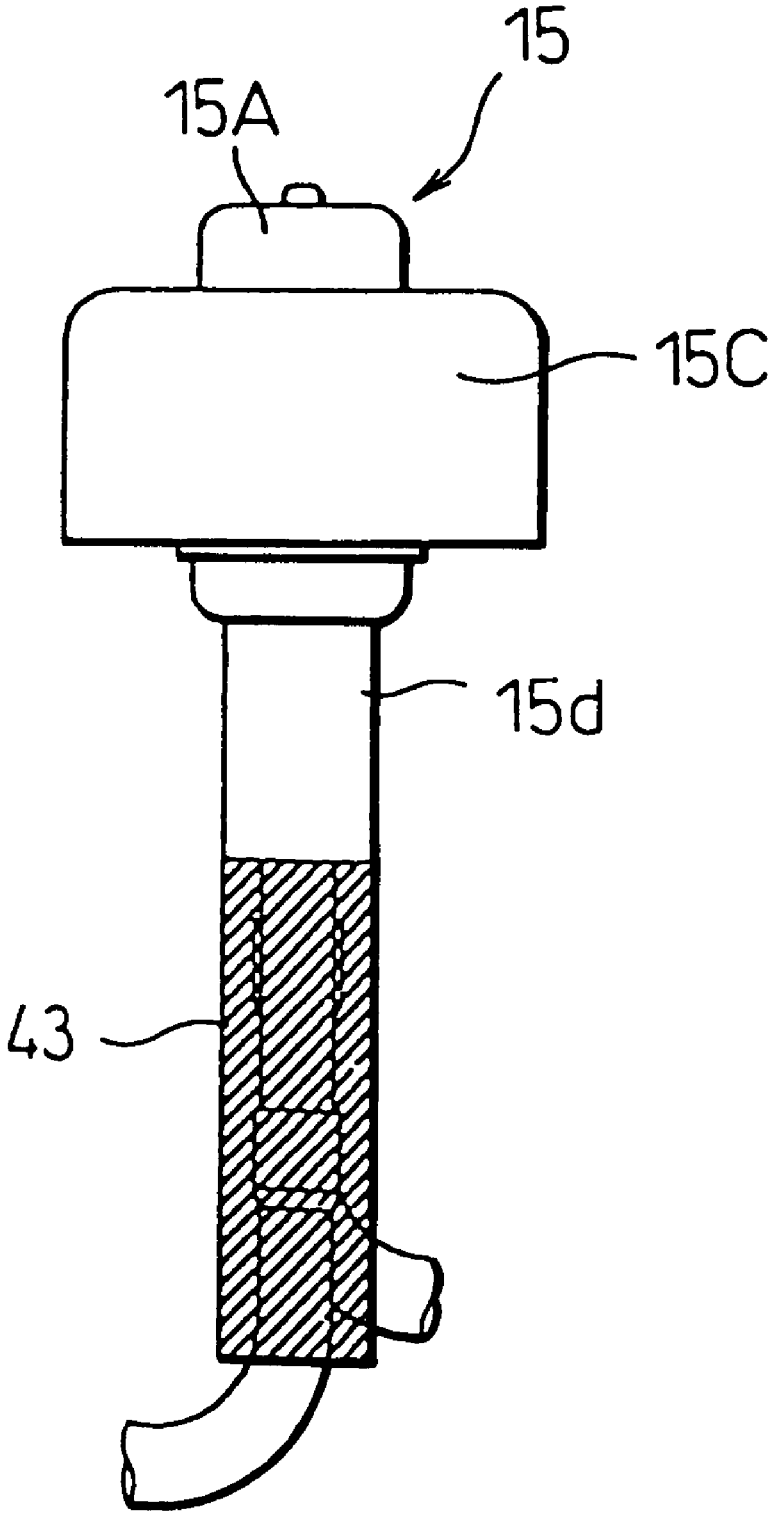
FIG. 6 is a front view of an electric expansion valve for use in the flow control unit.
Figure 7:
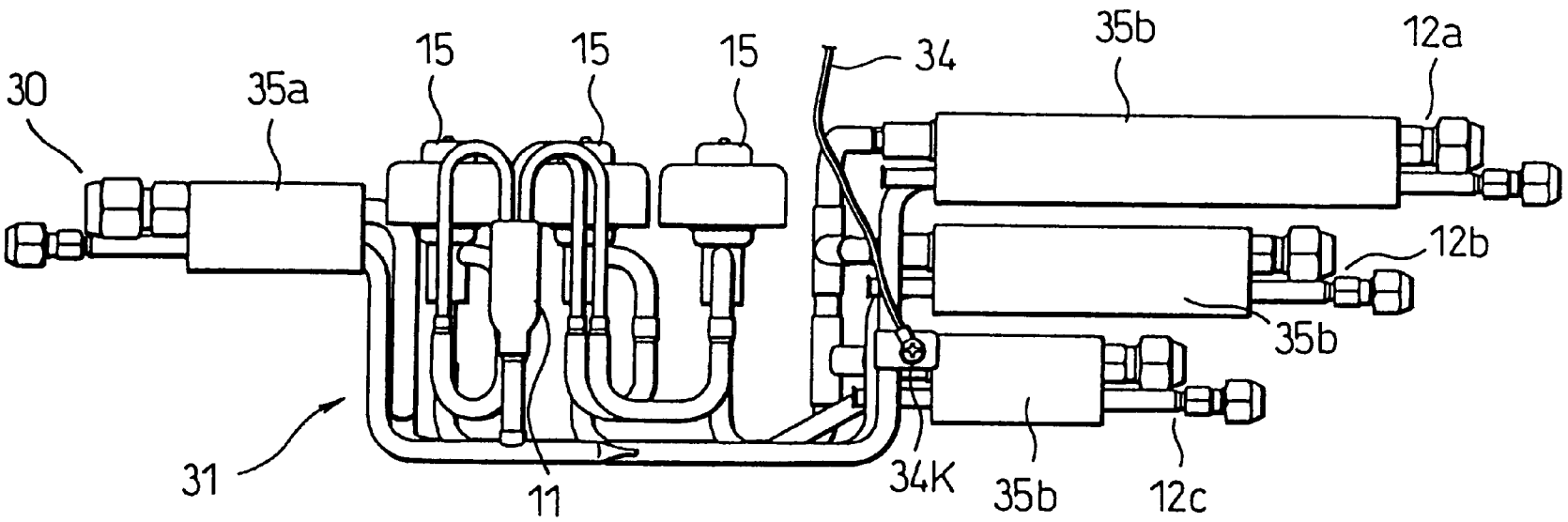
FIG. 7 is a front view of the flow control unit before it is installed in a metallic case.

Tube sections 15*b* of the electric expansion valves 15 are wrapped with a noise suppressing material 43 made of rubber for example, to absorb unpleasant noise caused by the passage of the refrigerant, as shown in FIG. 6.

Figure 5:
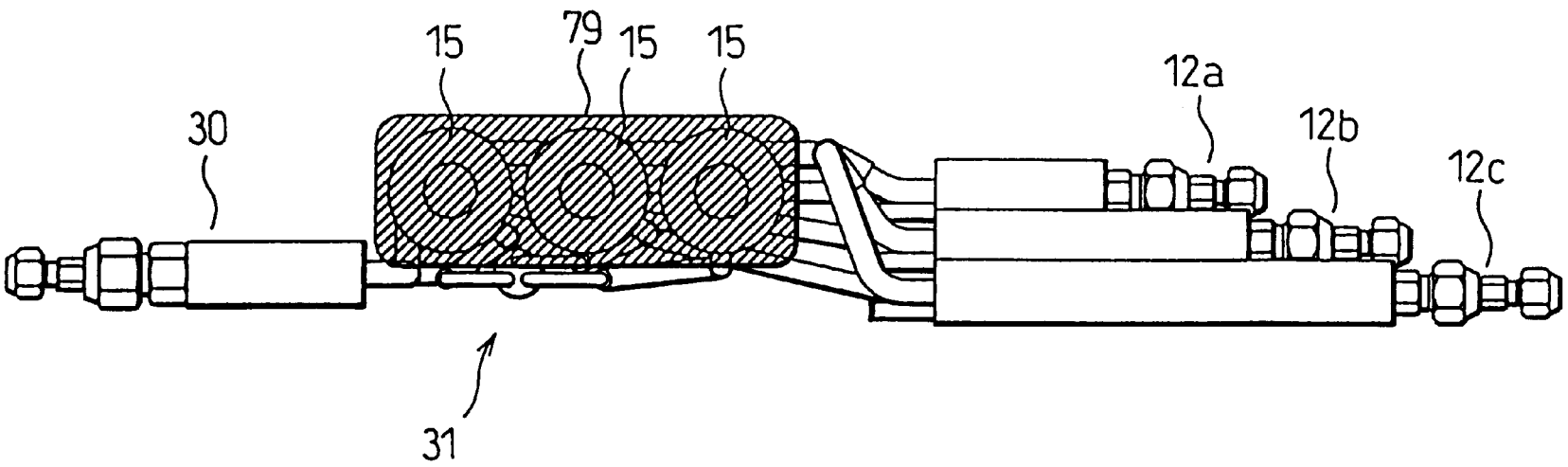
FIG. 5 is a plan view of the flow control unit shown in FIG. 4.

A grounding wire 34 is connected to a ground terminal 34K. The two connection tubes 30 extending from one end of the refrigerant distribution unit 10 and of the three pairs of the branch tubes 12*a*–12*c* extending from the other end of the refrigerant distribution unit 10 are protected by covers 35*a* and 35*b*, respectively, made of rubber or the like. The entire flow control unit 31 is protected by a shock absorbing rubber member 79, as shown in FIG. 5.

The flow control unit 31 described above is secured in a metallic box made of five metal plates screwed together and is covered with a metal plate 40 (FIG. 9) to form the enclosed parallelepiped case 36. In order to thermally insulate the flow control unit 31 from the metallic case 36, the flow control unit 31 is further embedded in a heat insulator which fills a space between the flow control unit 31 and the metallic case 36, as described in detail below. This is necessary because, otherwise, dew would be deposited on the cooled metallic case 36 installed in the attic during a cooling mode of the air-conditioner, so that a drain pan or a drain tube would be needed to remove the dew.

Referring now to FIGS. 9–12, there is shown a process in which a refrigerant distribution unit 10 is fabricated according to the invention.

Figure 11:
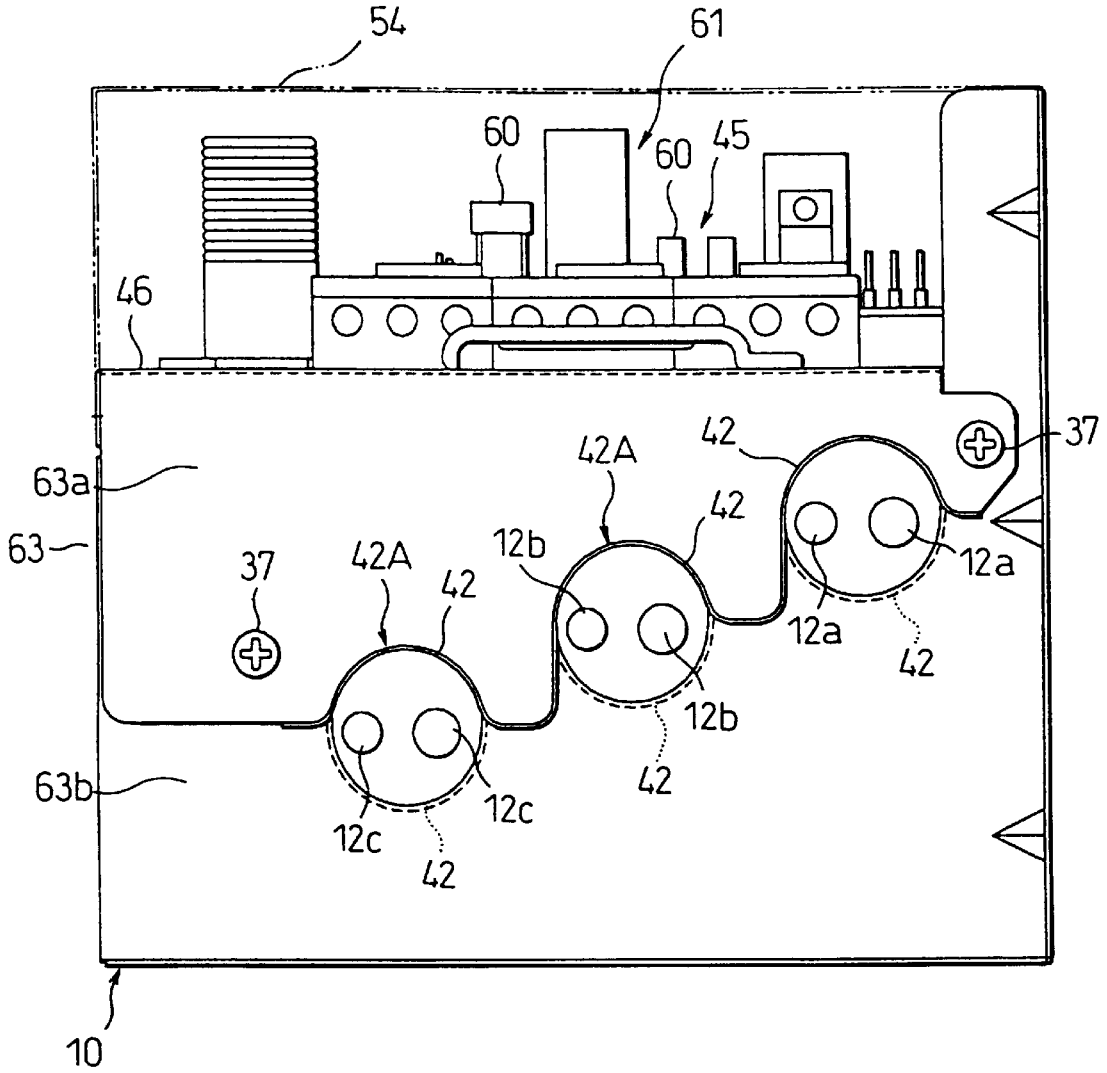
FIG. 11 is a side view of the refrigerant distribution unit, with an electric control panel mounted thereon.

As shown in FIG. 11, each of the side panels 63 of the box is made up of an upper and lower sections 63*a* and 63*b*, respectively, each having a semi-circular cut 42 such that when combined together the two semi-circular cuts form a round hole for allowing the connection tubes 30 and the branch tubes 12*a*–12*c* to extend out of the case. The upper and the lower plates 63*a* and 63*b* are coupled together and fixed by screws 37.

Figure 9A:
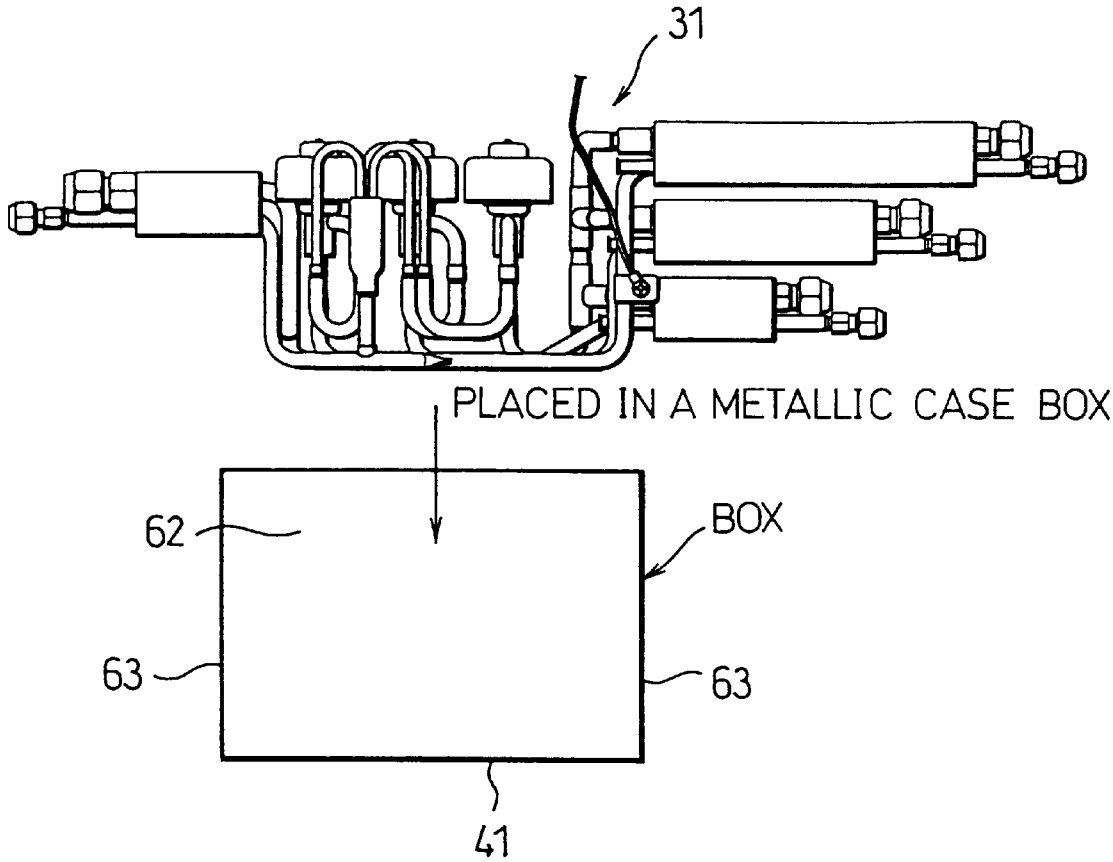
FIG. 9 illustrates a first stage of manufacturing the urethane-molded refrigerant distribution unit prior to molding foamable urethane in the metallic case, showing a step of placing a flow control unit in a metallic box (Step (A)) and enclosing the unit with a lid (Step (B))
Figure 9B:
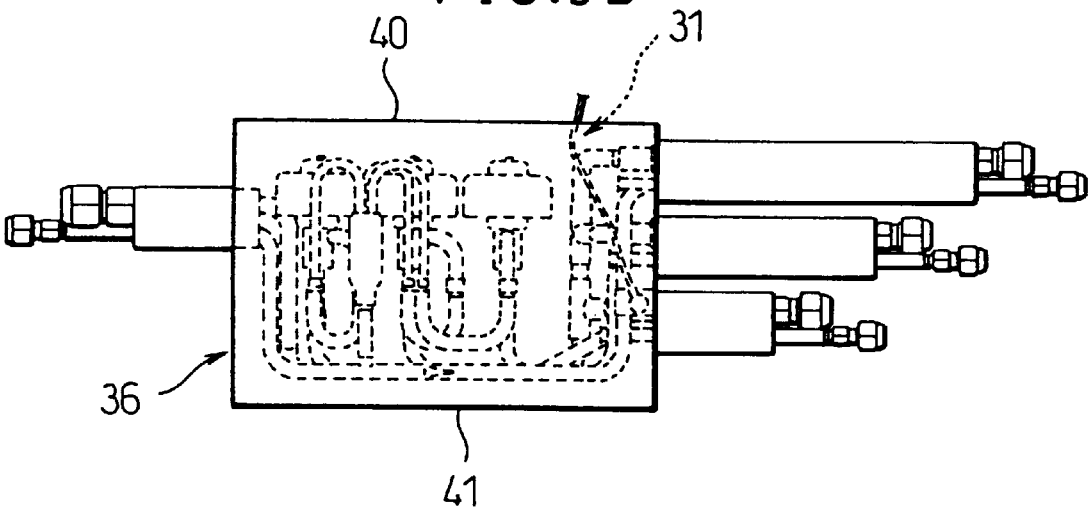
Figure 10:
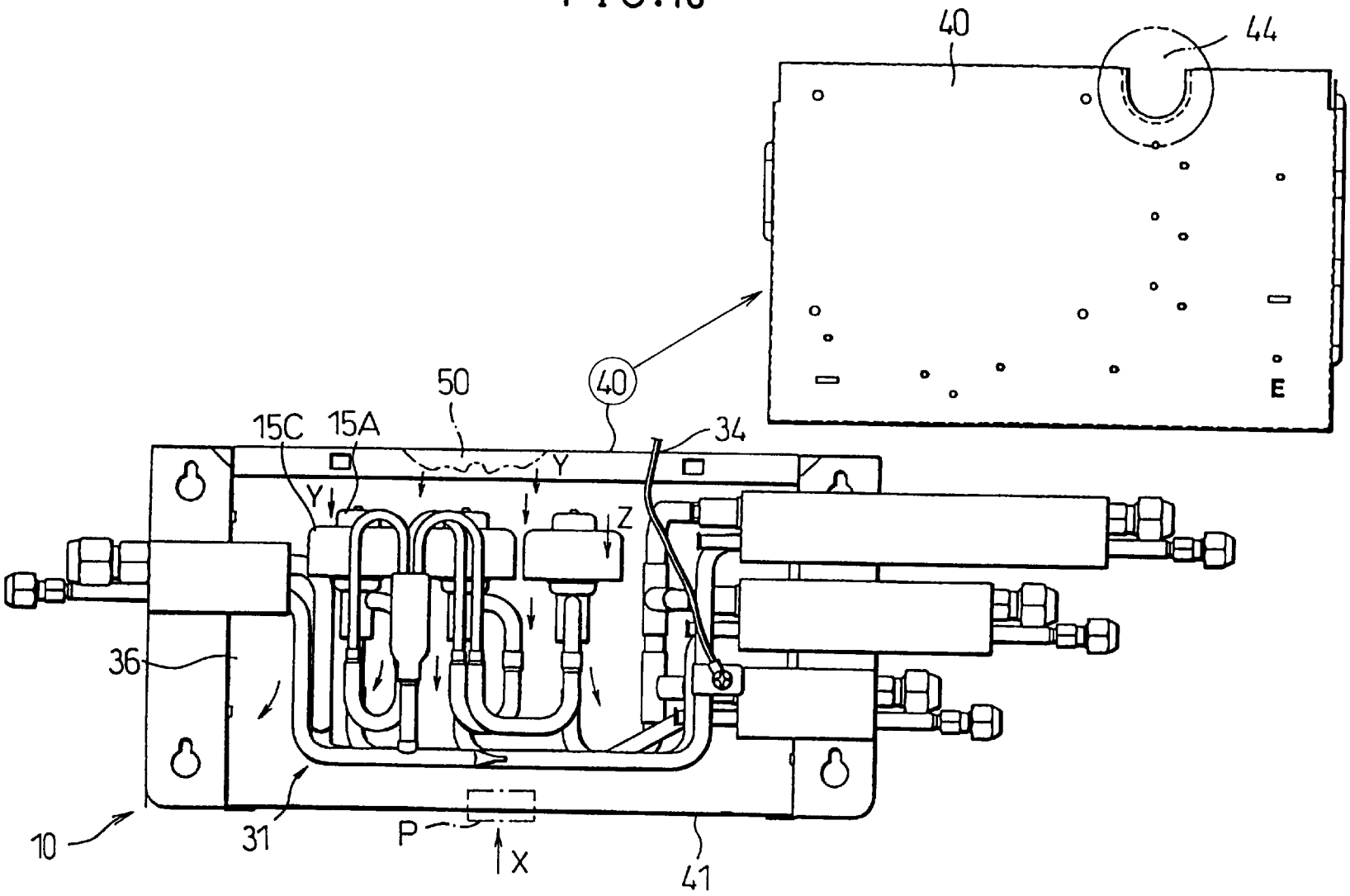
FIG. 10 shows the inner structure of the refrigerant distribution unit with its flow control unit encapsulated in the metallic case, prior to molding the heat insulator (foamed urethane), FIG. 10 also showing how the foamed urethane expands in the box of the refrigerant distribution unit.

After the flow control unit 31 is placed in the box, the upper plate 40 is secured on the upper end of the box to enclose the case 36. The grounding wire 34 connected with the flow control unit 31 is led out of the case through a round hole 44 formed in the upper plate 40 prior to mounting the upper plate 40 on the case 36, as shown in FIGS. 9 and 10.

Figure 12:
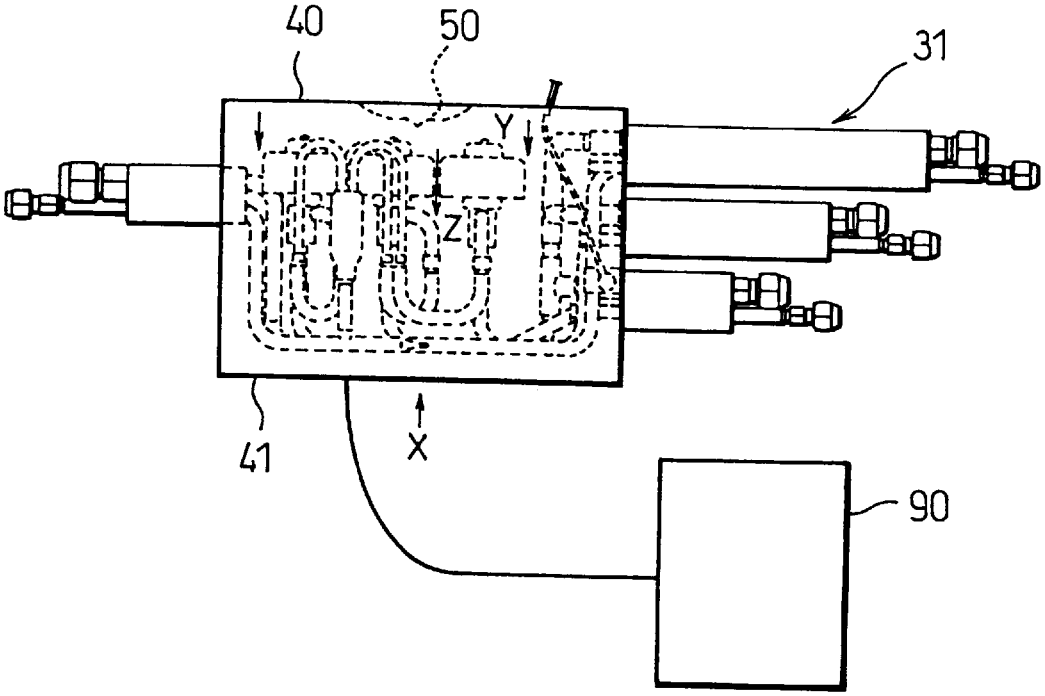
FIG. 12 shows a stage in which foamable urethane is injected by a foam injection apparatus into the metallic case accommodating the flow control unit.
Figure 13:
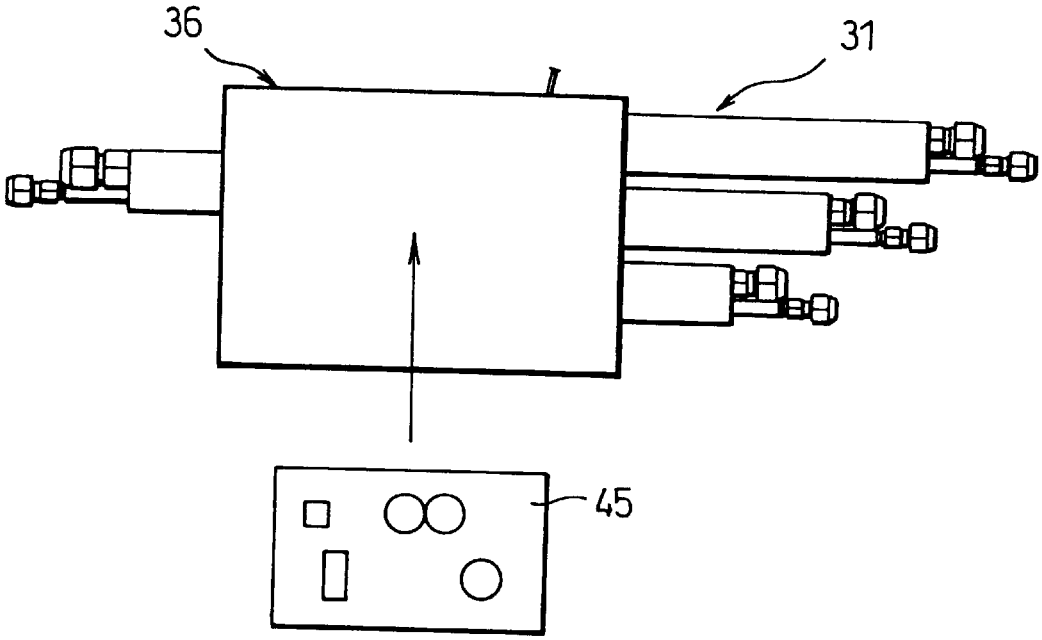
FIG. 13 shows how electric components are mounted on the case subsequent to molding the heat insulator.

The case 36 accommodating therein the flow control unit 31 is set up in a preheated expansion jig, which injects a foamable liquid resin into the case 36. The case 36 is further heated externally until the flow control unit 31 inside the case 36 reaches a specified temperature so that the resin expands at an optimal temperature and fills the vacant space in the case 36, forming a heat insulator 50 (FIG. 12). The preheating of the jig is carried out by first heating the jig in a furnace to about 40° C. Acceptable temperature of the furnace is in the range of 35–60° C., which may be varied depending on other conditions such as a seasonal change in ambient temperature, for example.

With the expansion jig heated to about 40° C., the flow control unit 31 may be heated to a temperature between 30° C. and 40° C., which is adequate to expand the resin. The temperature of the flow control unit 31 may be controlled by measuring the temperature of the jig and the flow control unit 31.

The heat insulator 50 may be a foamed urethane, which is suitable because it will not undergo a secondary expansion caused by absorption of water and damage the case 30, or it will not catch fire in a case of a fire accident.

In the example shown herein a liquid resin that is injected in the case 30 is a liquid urethane, which is a mixture of 50 weight % of polyol MS-0126(R) and 50 weight % of isocyanate MS-0126(I).

The liquid urethane is then injected into the case 30 by an injection apparatus 90 (FIG. 12). It should be noted that, in accordance with the invention the liquid resin is injected in the case 30 and that the resin is caused to be expanded in the direction indicated by an arrow Y which coincides with the direction Z in which a stator section 15C encasing therein a stator coil of the electric expansion valve 15, an essential component of the flow control unit 31, is fitted on the main body of the expansion valve 15, so that expansion of the resin causes the stator coil section to be secured on the main body of the expansion valve, as described in detail below.

Referring again to FIG. 10, each of the electric expansion valves 15 has a main body 15A which includes a valve therein driven by the stator section 15C fitted on the main body 15A from above. When the liquid resin is injected by the injection apparatus 90, the entire refrigerant distribution unit 10 is placed upside down so that the resin is injected from above through an inlet port P formed in the bottom plate 41 as shown by a dotted line in FIG. 10.

As the liquid urethane is injected in the case 36, it drops onto the upper plate 40 and begins to expand towards the bottom plate 41 as shown by arrows Y, filling the space between the case 36 and the flow control unit 31. The air in the case 36 is expelled by the expanding urethane from the case through air escapes formed in the case 36.

It should be appreciated that the urethane that expands in the direction Y pushes the stator section 15C in the direction indicated by an arrow Z that coincides with the direction in which the stator section 15C is fitted on the valve body 15A, forcing the stator section in the indicated direction and keeping it in position.

The urethane injection is carried out under the following conditions.

First, each of the liquid polyol MS-0126(R) and isocyanate MS-0126(I) is maintained at a temperature between 15° C. and 25° C. before they are fed into the injection apparatus 90. The temperatures of these liquids are controlled by a spot cooler and a band heater, since the injection apparatus 90 has no temperature control means.

Second, the injection apparatus 90 is adjusted or calibrated to mix these liquids in a specified composition, which is 50–50 weight % in the example shown herein.

The injected urethane 50 is let go a free expansion for a few minutes so that it completely fills the void space in the case 36. In order to obtain an adequate expansion rate of the mixture prior to starting the expansion process, it is recommended to check the condition of the injection apparatus 90 by giving a trial expansion. Such a check may be performed, for example, at the beginning of the morning shift, after a first recess (e.g. at 10 a.m.), at the beginning of the afternoon shift, after a second recess (e.g. at 3 p.m.) , and before the evening shift.

The urethane filling process as described above, proceeds with the following procedure, which includes the steps of:

(1) Heating the refrigerant distribution unit and the expansion jig to a required temperature;

(2) Setting the refrigerant distribution unit in the expansion jig;

(3) Injecting the liquid foamable material in the expansion jig (The amount of the foamable material injected in the expansion jig may be estimated from the size of the foams formed on the air vents of the case. If the refrigerant distribution unit is filled with an adequate amount of expanded resin, egg-size foams are formed on the air vents);

(4) Curing the expansion material;

(5) Removing the product from the expansion jig;

(6) Checking the condition (outlook) of the refrigerant distribution unit.

(7) Removing urethane foams appearing on the air vents.

The following steps are also taken for the above procedure.

(1) Determination of the temperature of the expansion jig:

The temperature must be checked before each expansion operation.

(2) Calibration of the expansion jig.

Calibration must be made as described previously, at the beginning of the expansion process, as in the case of free expansion.

(3) Free expansion test.

A trial free expansion is made under the conditions as described previously.

After the expansion process, an electric circuit board 45 having thereon electric components 60, such as a microcomputer 60M and other circuit elements for controlling the refrigerant distribution unit, is mounted on one side 46 of the case 36, as shown in FIGS. 11, 13, 14, and 15.

Arranged between the electric circuit board 45 and the case 36 is an electrical insulation sheet 47. The electric circuit board 45 is supported at the four corners thereof by plastic legs 80 over the side 46 so that it is electrically insulated from the case 36 to avoid short circuiting with the case 36.

Figure 14:
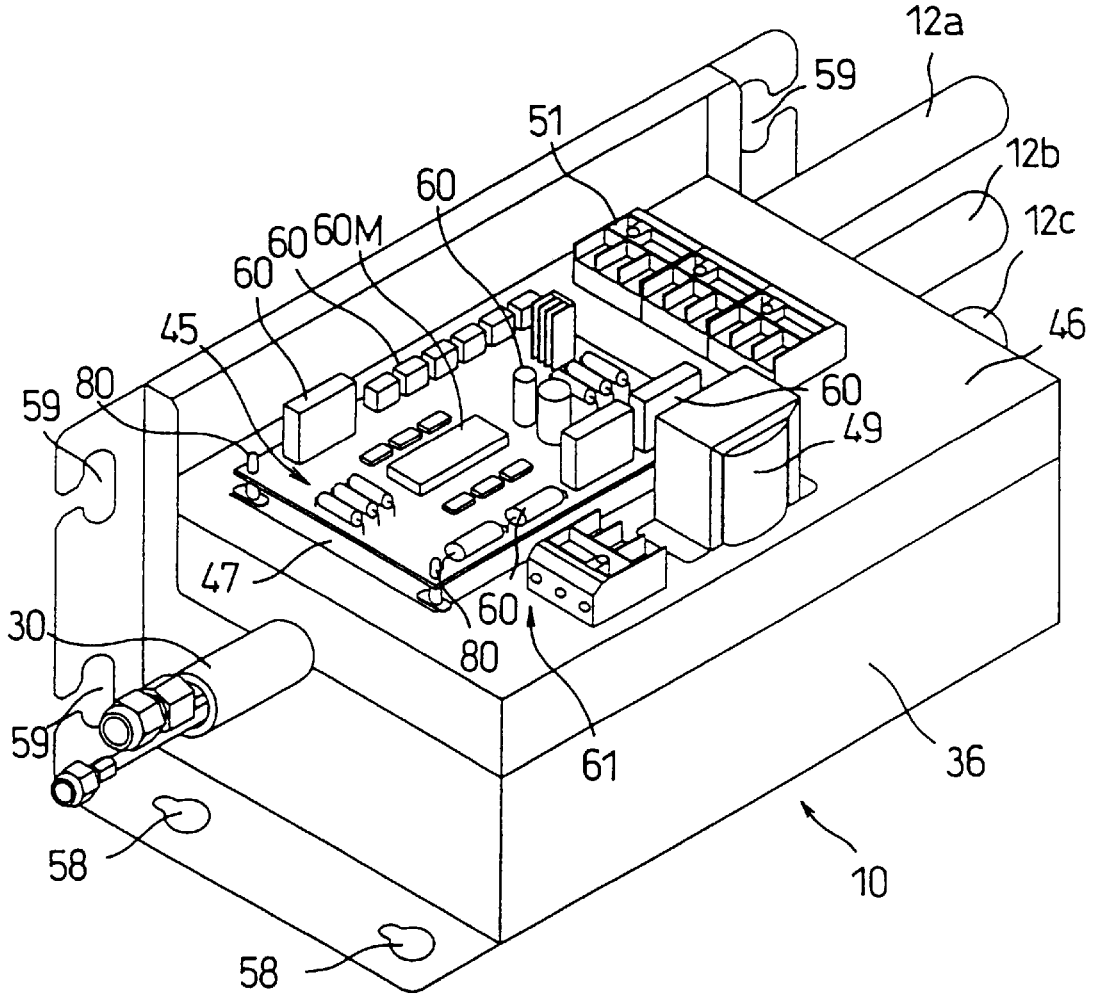
FIG. 14 is a perspective view of a refrigerant distribution unit with an electric circuit board mounted on the case but electrically insulated from the case by means of an insulating sheet and plastic legs.
Figure 15:
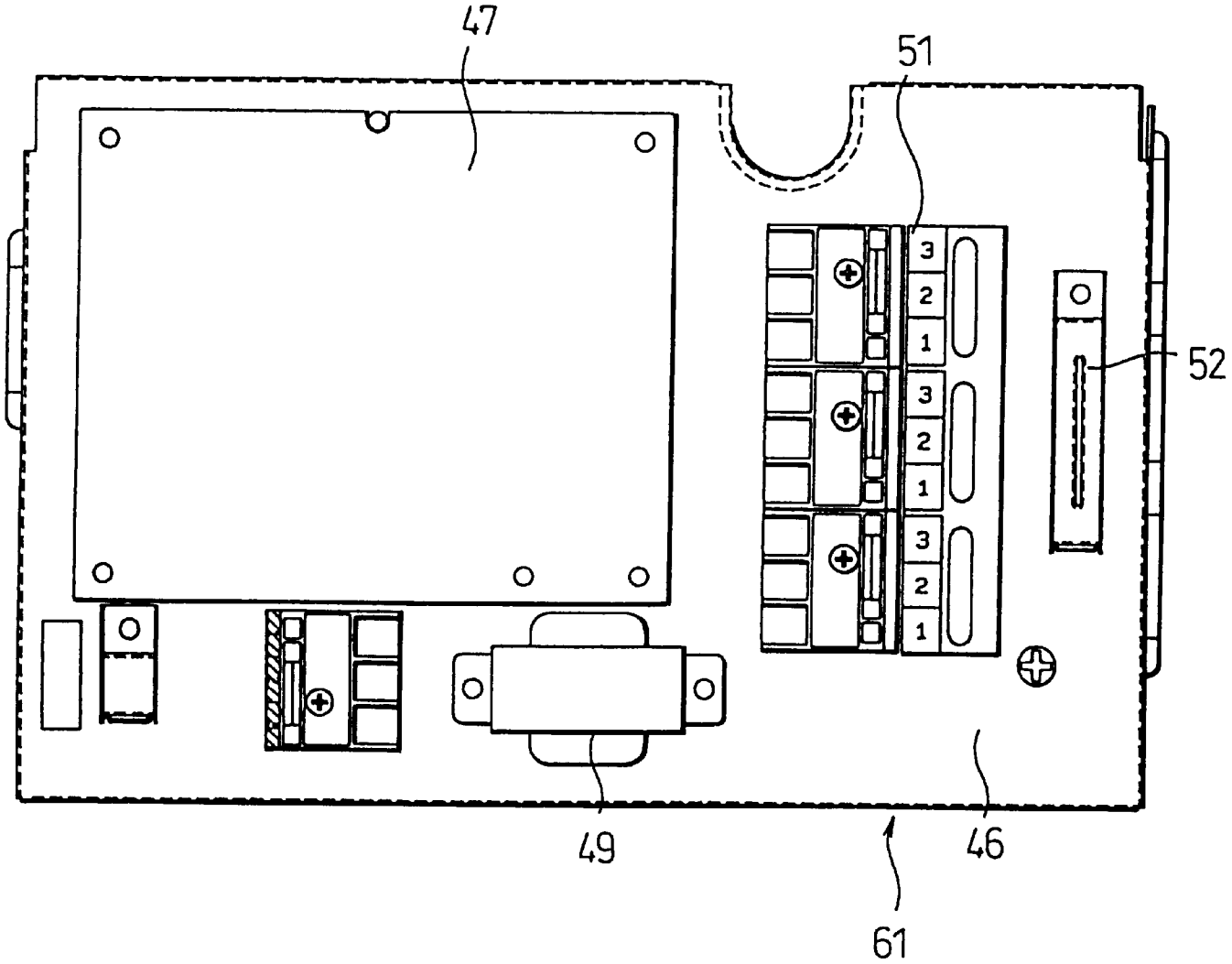
FIG. 15 shows a side of the case on which the electric circuit board and electric components are mounted.

FIG. 14 shows an outlook of an almost completed refrigerant distribution unit 10 equipped with the electric circuit board 45 along with some extra components such as a transformer 49, terminal board 51, and lead holder 52 on the side 46.

In the process of forming an expanded insulator in the case 36 of the refrigerant distribution unit 10 as described above, the electric components may be mounted only after the expansion process is completed.

Furthermore, it is not quite easy to mount the electric components on the case 36 after the flow control unit 31 is mounted in the box and finished with the expansion process, since then the connection tubes 30 and branch tubes 12*a*–12*c* extend out of the case 36. Therefore, manufacturing efficiency is low in this process.

The efficiency may be improved by an alternative expansion procedure, in which the flow control unit 31 may be covered with an expanded plastic insulator in a separate expansion jig before it is mounted in the case 36. In this case, electric components may be mounted on the case 36 simultaneously with the expansion process, so that the above mentioned difficulties may be avoided, thereby improving the manufacturing efficiency.

Figure 16A:
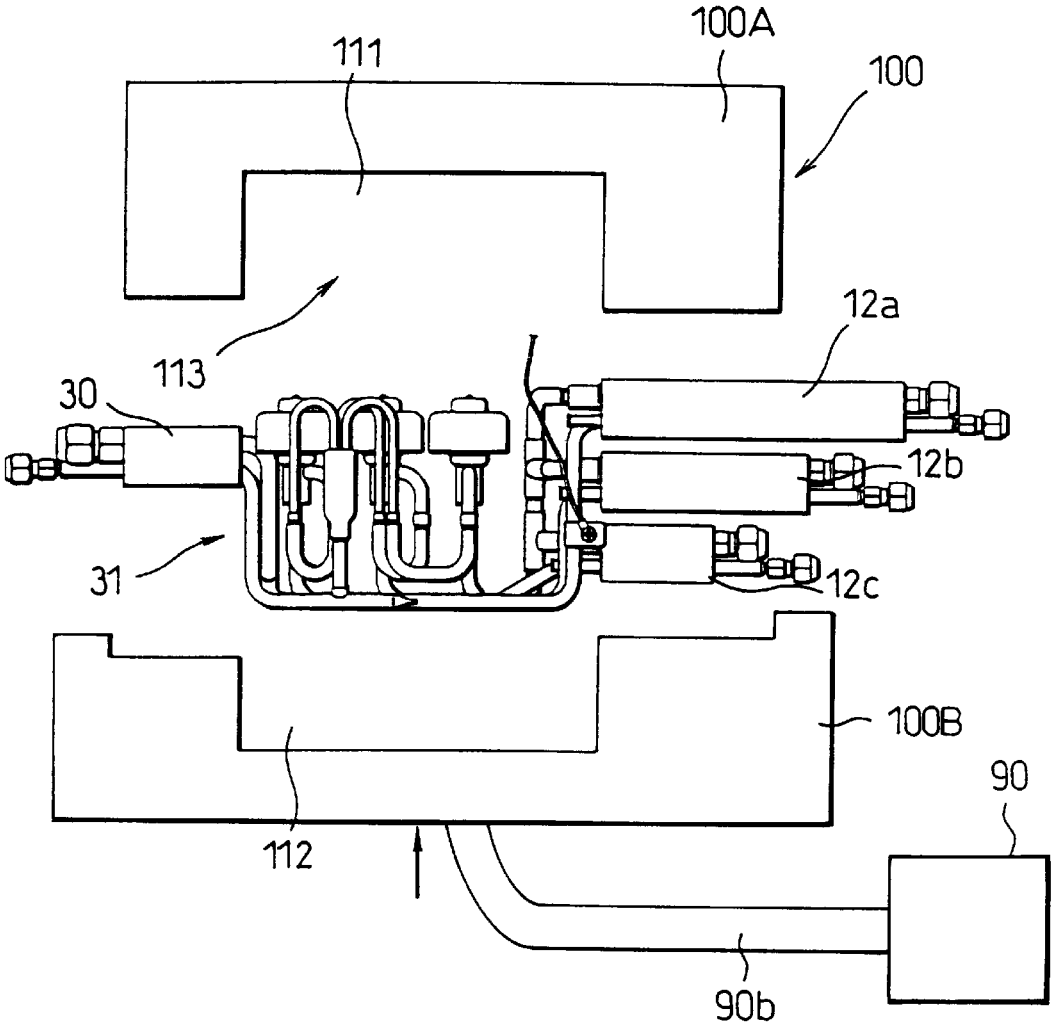
FIG. 16 shows a step of molding or expanding a foamable material on a flow control unit placed in an expansion jig: Step (A) illustrating the expansion jig prior to the molding; and Step (B) is the front view of the flow control unit embedded in a parallelepiped foamed insulator after the molding.

This process will be described with reference to FIGS. 16 and 17. As shown in FIG. 16A, the flow control unit 31 is directly set between an upper mold 100A and a lower mold 100B of an expansion jig 100. The upper mold 100A has a recess 111 formed on the lower side thereof, and the lower mold 100B a recess 112 formed on the upper side thereof. The two recesses are configured to form a space 113 having the same configuration as the inner space of the case 36 when the two molds are coupled together.

Figure 16B:
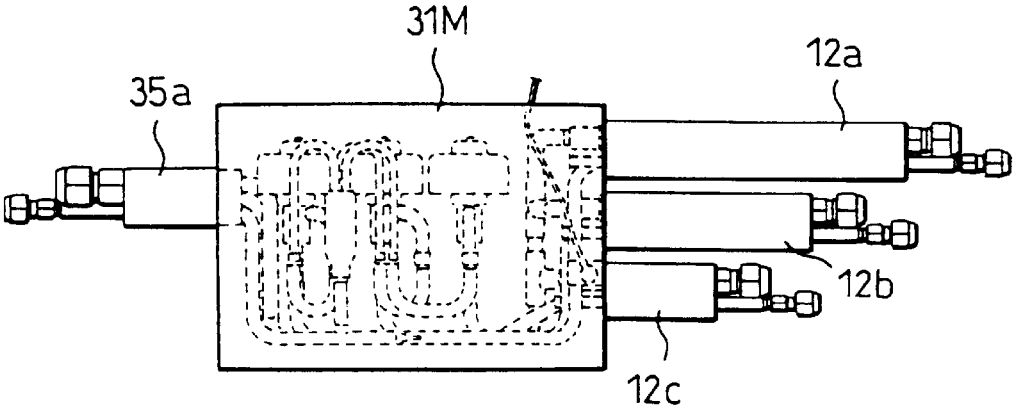

With the flow control unit 31 set in the expansion jig 100, a volume of liquid urethane is injected into the space 113 by an injection apparatus 90 through an injection port of the expansion jig. The urethane is expanded in the space 113 and covers the flow control unit 31, forming a generally parallelepiped heat insulator of foamed urethane, as shown in FIG. 16(B).

Figure 17:
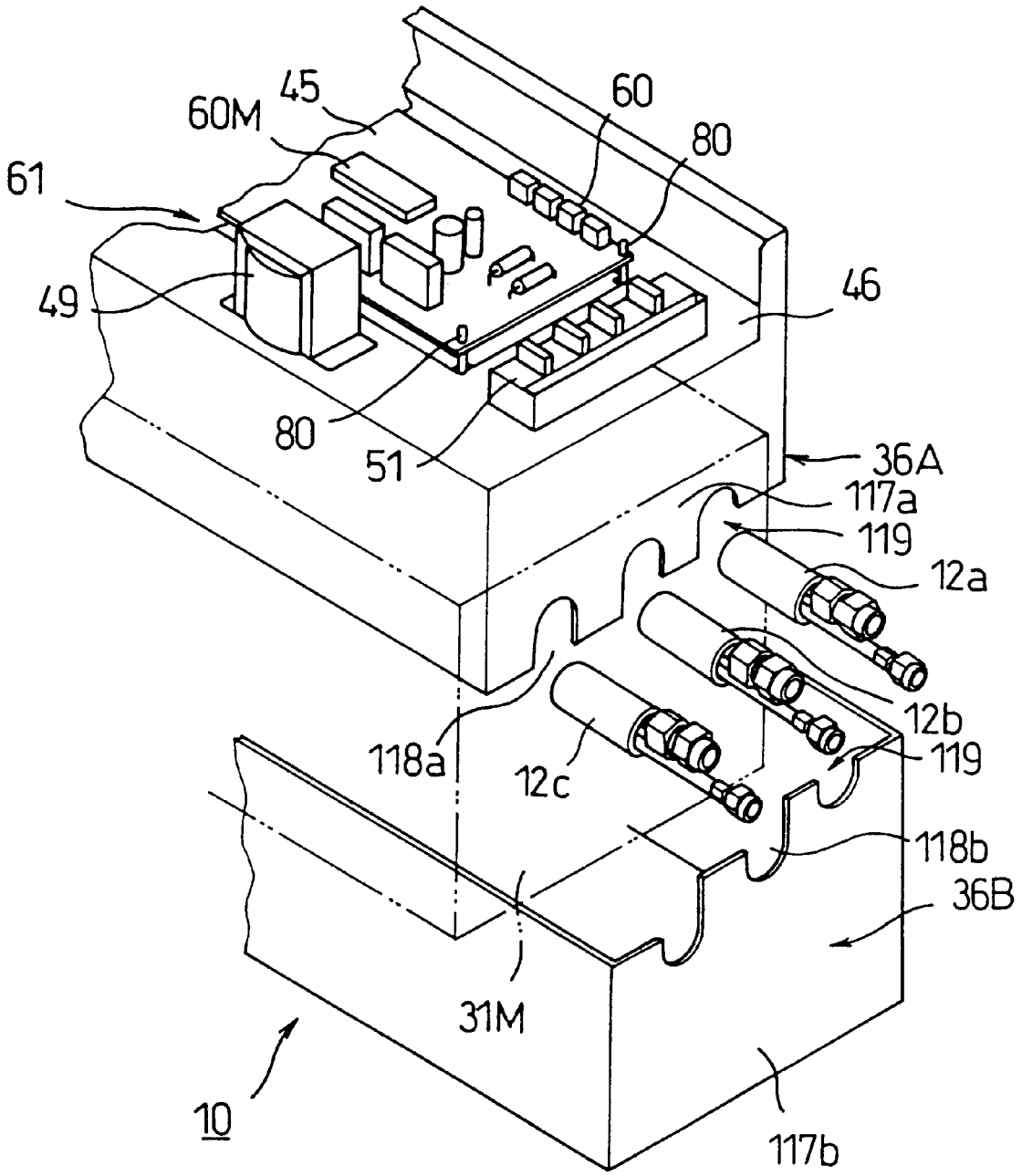
FIG. 17 shows a step of assembling a pair of casing members on the foam-molded flow control unit shown in FIG. 16.

A resultant product 31M which is the flow control unit 31 embedded in the urethane is removed from the expansion jig, to be fitted subsequently in the case 36 made up of an upper and a lower casing members 36A and 36B, as shown in FIG. 17.

At the same time as, but independently of, the expansion process described above, an electric circuitry 61 is formed by mounting the electric circuit board 45 and other electric components 49 and 51 on the side 46 of the casing member 36A.

The molded product 31M is then sandwiched by the casing member 36A having the electric circuitry 61 and its counterpart member 36B.

The refrigeration tubes 30 and the branch tubes 12*a*–12*c* are fitted in semi-circular cut sections 118*a* and 118*b* of the side panels 117*a* and 117*b* of the casing members 36A and 36B so that part of the tubes 30 and 12*a*–12*c* can extend from the case 36. These casing members 36A and 36B are united together with screws, which completes assembling of the refrigerant distribution unit 10.

It would be appreciated that the electric components may be easily and hence efficiently mounted on the box 36, since the flow control unit 31 is not yet mounted in the box.

Figure 18:
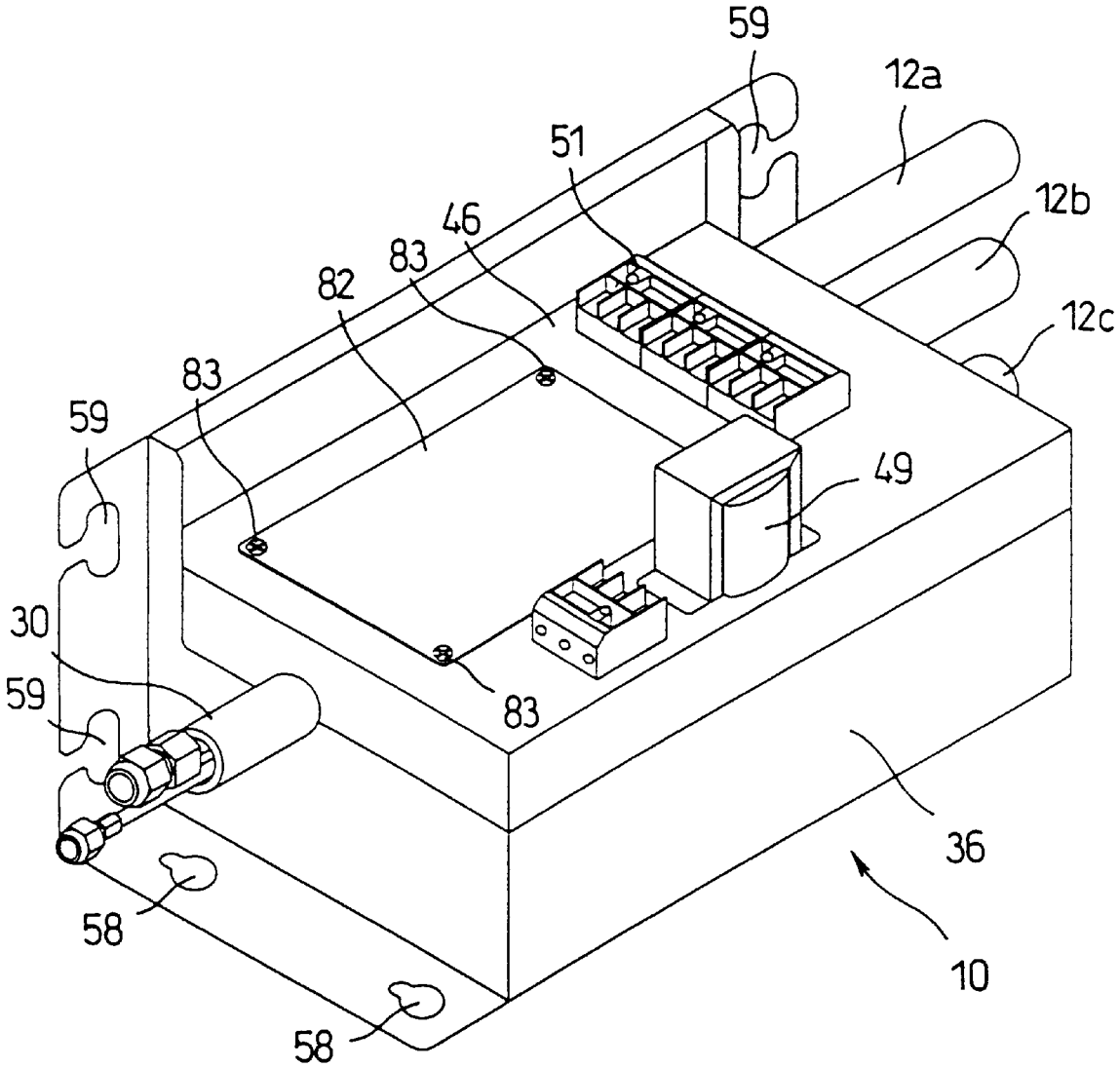
FIG. 18 is a perspective view of the refrigerant distribution unit, whose metallic case has a removable plate for covering an opening in the case and for exposing a section of the heat insulator in the case when the plate is removed.
Figure 19:
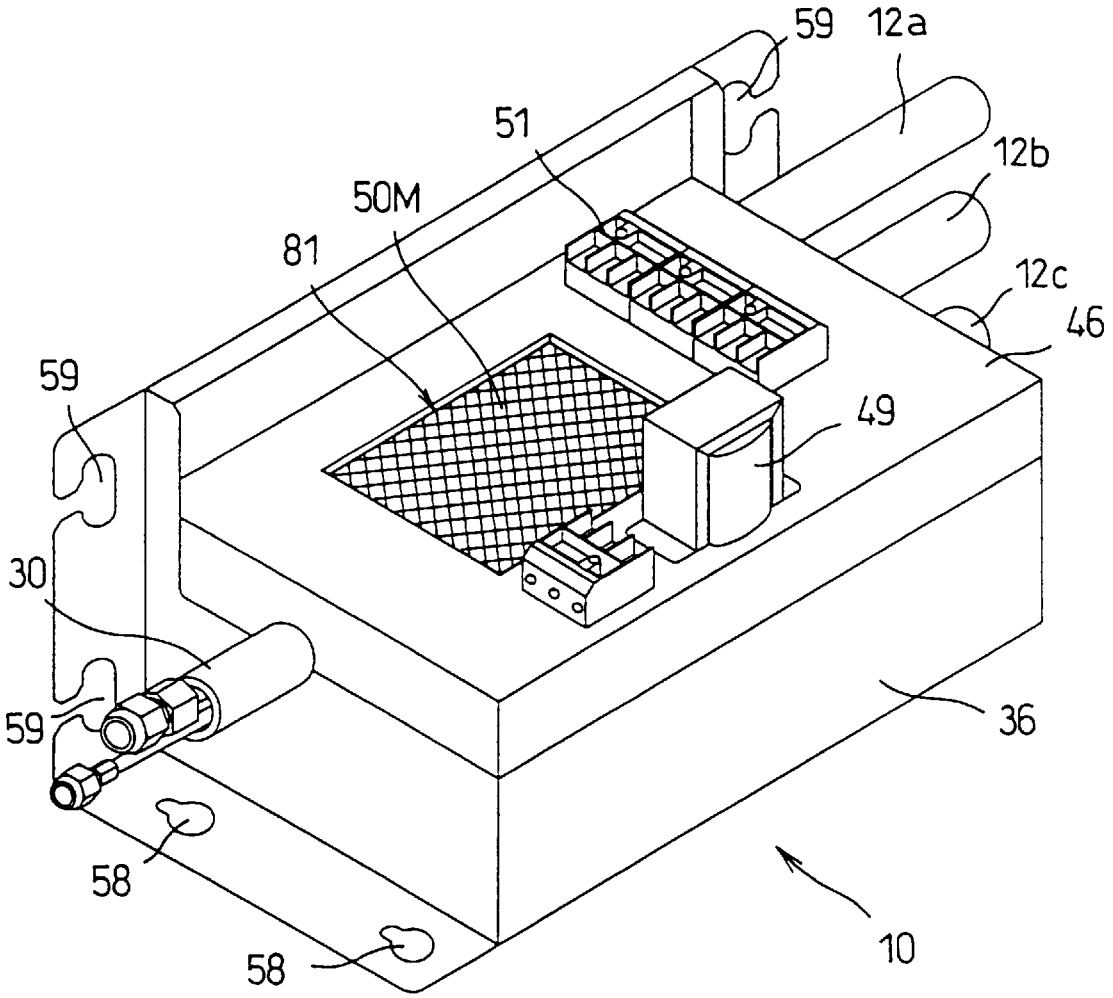
FIG. 19 is a perspective view of the refrigerant distribution unit with the plate removed from the case to expose the heat insulator in the opening.
Figure 20:
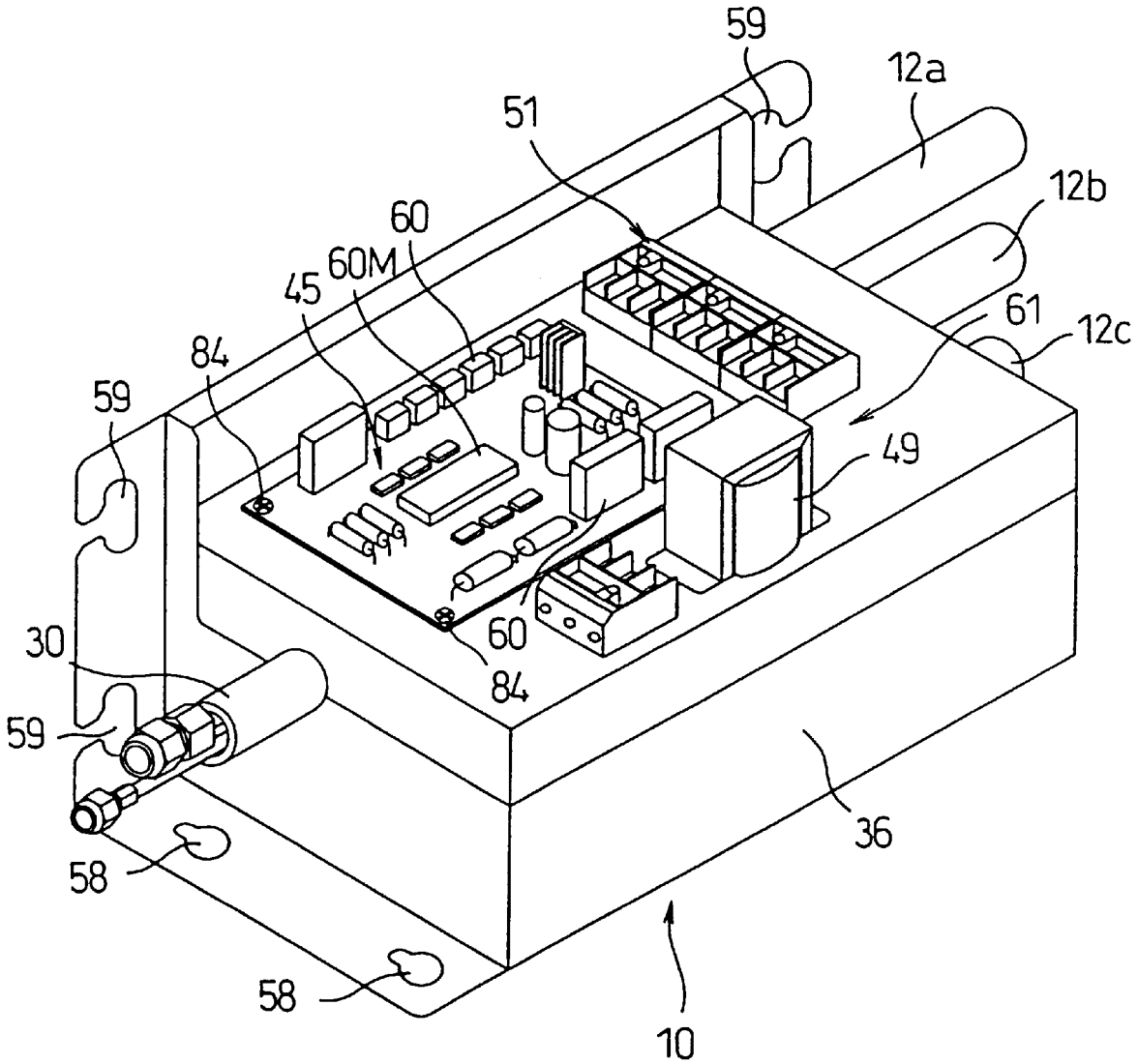
FIG. 20 is a perspective view of the refrigerant distribution unit having a control panel directly mounted on the exposed section of the heat insulator.

Referring to FIGS. 18–20, there is shown a still further aspect of the invention, in which the electric circuit board may be directly and securely mounted on the box 36 in a electrically well insulated condition without recourse to the electrical insulation sheet 47 or plastic legs 80 as described above. Since fewer elements are involved in this example as compared with the preceding ones, a more reliable refrigerant distribution unit may be assembled in a more efficient way.

In this example, the case 36 is provided in the side 46 thereof with an opening 81 for exposing a section 50M of the expanded resin. The opening is large enough and has a substantially the same shape as the electric circuit board 45 for accommodating therein the electric circuit board 45, so that the electric circuit board 45 may be directly mounted on the exposed resin as a part of the electric circuitry 61 on the side 46. The opening 81 is covered with a lid 82 with screws during the injection/expansion process described above. The lid 82 is removed by removing the screws after the injected resin is fully solidified, allowing the section 50M of the expanded urethane 50M to be exposed in the opening 81 as shown in FIG. 19.

The electric circuit board 45 is firmly secured on the exposed section 50M by fixing the four comers of the electric circuit board 45 on the case with screws 84.

It could be understood that neither of the previously described insulating sheet 47 nor the plastic legs 80 are needed in this arrangement to keeping the electric circuit board 45 insulated from the metallic box 36.

This arrangement is advantageous over the preceding examples in that the number of elements as well as the number of steps for assembling the refrigerant distribution unit 10 is minimized. In addition, the overall dimensions of the refrigerant distribution unit 10 may be also reduced since the electric circuit board 45 is directly mounted on the foamed urethane without intervening members like the legs 80.

Figure 21A:
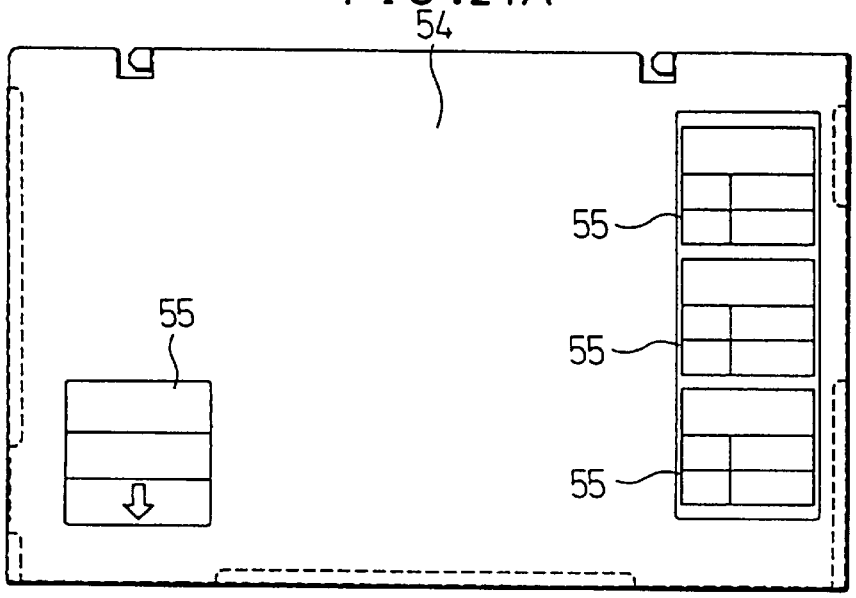
FIGS. 21 (A), (B), and (C) are a plan view, a front view, and a right side view, respectively, of a protective cover of the control panel shown in FIG. 20.
Figure 21B:
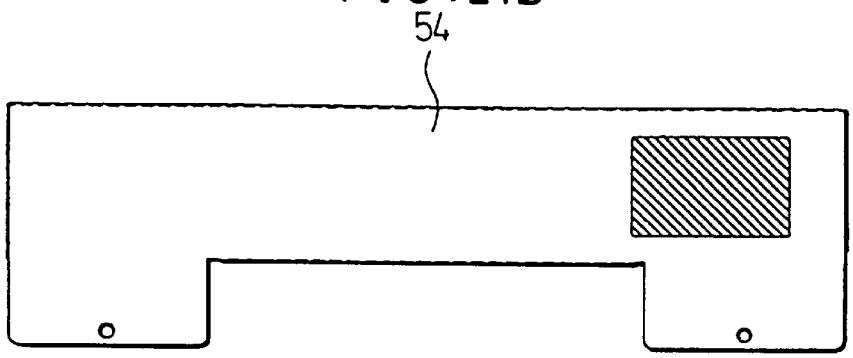
Figure 21C:
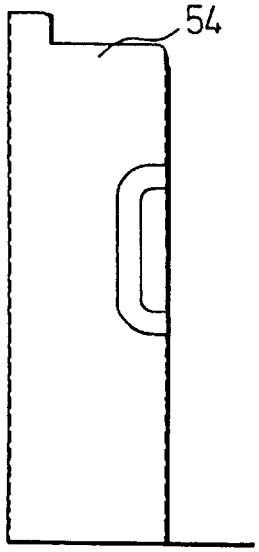
Figure 22A:
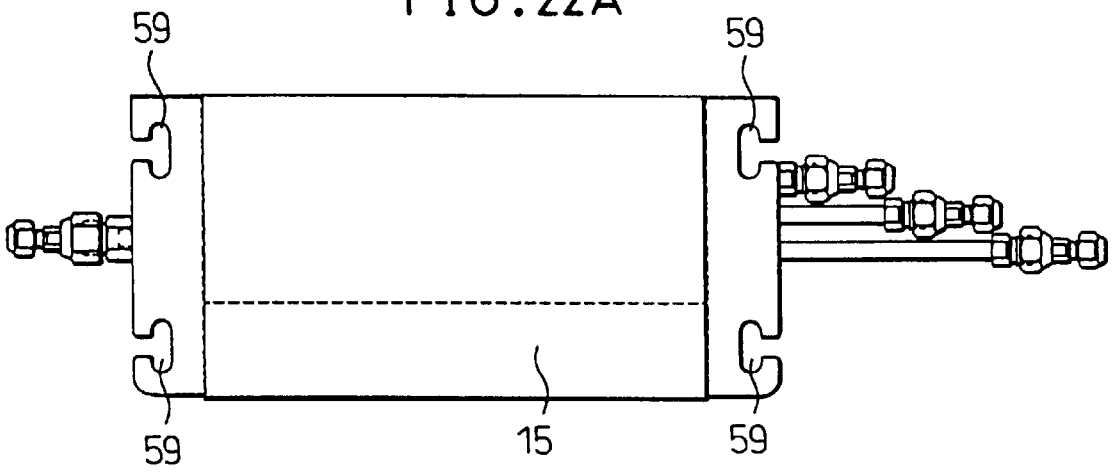
FIGS. 22 (A), (B), and (C) are a front view, a plan view, and a right side view, respectively, of an assembled refrigerant distribution unit.
Figure 22B:
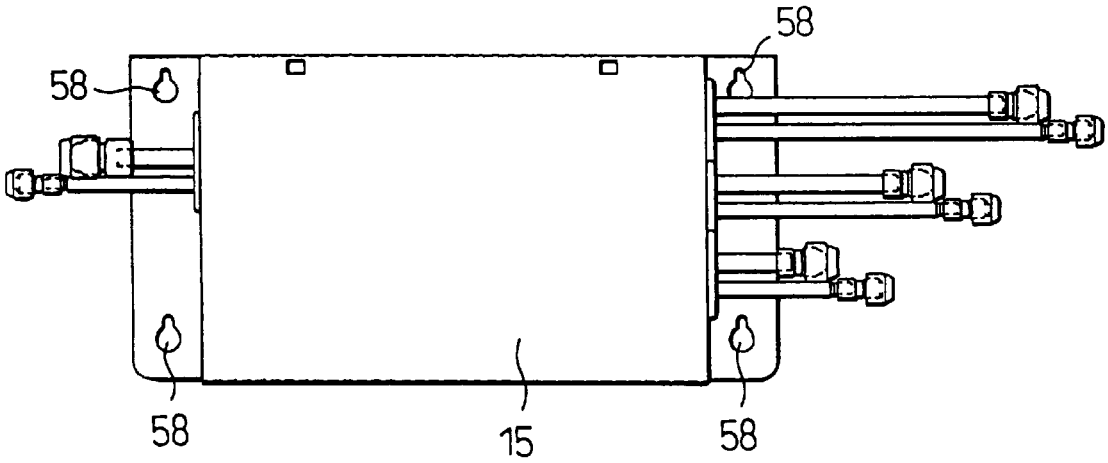
Figure 22C:
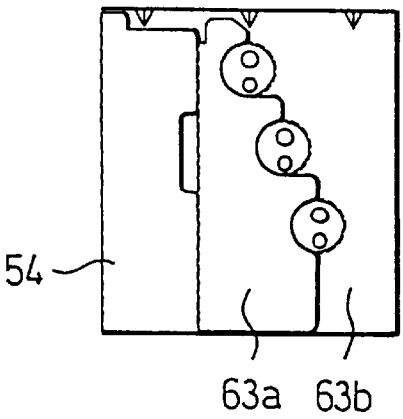

Finally, following the installation of the electric circuitry 61 on the side 46, a cover 54 made up of several cover pieces is assembled on the case 36 by screws to protect the electric circuit board 45 and other electrical components 49, 51, and 52 from dust and/or rats, as shown in FIG. 21. Attached on the surface 54 of the completed refrigerant distribution unit 10, as shown in FIG. 17, is a plate having specifications 55 of the unit printed thereon, as shown in FIG. 22.

The refrigerant distribution unit 10 thus completed may be installed in the attic, for example. It is preferably located at the same distance from the indoor units, as shown in FIGS. 14 and 22. It may be fixed easily on a beam of the building, for example by bolts borne in mounting holes 58 or cuts 59 formed in one side of the case 36.

As previously described, since the refrigerant distribution unit 10 is thermally insulated by a molded insulator 50 of foamed urethane and the like, the case 36 is prevented from depositing dew, so that no drainage conduit is needed if the refrigerant distribution unit 10 is installed in the attic. This advantageously permits easy installation of the air conditioning system.

What we claim is:

1. An integrated refrigerant distribution unit for use with a multiplex air-conditioning system to provide, through a multiplicity of refrigerant tubes connected therewith, refrigerant to a multiplicity of indoor units connected with a single outdoor unit, said refrigerant distribution unit comprising:

means connected with one of said refrigerant tubes for receiving said refrigerant from said outdoor unit to distribute optimal flows of refrigerant to said connected multiple indoor units; and wherein said refrigerant distribution unit is adapted to be installed at a flat place inside a building.

2. The refrigerant distribution unit as claimed in claim 1, adapted to be installed at a position which is closer to said indoor units than to said outdoor unit.

3. The refrigerant distribution unit as claimed in claim 2, adapted to be installed at a substantially equal distance from each of said indoor units.

4. An integrated refrigerant distribution unit for use with a multiplex air-conditioning system providing, through a multiplicity of refrigerant tubes connected therewith, refrigerant to a multiplicity of indoor units connected with a single outdoor unit, said refrigerant distribution unit comprising:

means connected with one of said refrigerant tubes for receiving said refrigerant from said outdoor unit to distribute optimal flows of refrigerant to said connected multiple indoor units, wherein said means comprises;

a flow control unit including a distributor connected with said one refrigerant tube extending from said outdoor unit for distributing said refrigerant to multiple channels;

a multiplicity of branch tubes each connected at one end thereof with one of said channels of said distributor and connected at the other end thereof with one of said indoor units; and electric valves, provided one in each of said branch tubes, for controlling the flows of refrigerant that pass through said multiplicity of branch tubes, said control unit including a case for enclosing said flow control unit, and wherein said refrigeration distribution unit is adopted to be installed at a flat place inside a building.

5. The refrigerant distribution unit as claimed in claim 4, wherein said case is made of a metal; and a space between said case and said refrigerant distribution unit is filled with an expanded heat insulator.

6. The refrigerant distribution unit as claimed in claim 5, wherein said case is provided in one of its sides with an opening for exposing a section of said expanded heat insulator such that an electric circuit board is securely mounted on said exposed section.

7. The refrigerant distribution unit as claimed in claim 5, wherein said expanded heat insulator is made from a foamable urethane having a composition of 50 weight percent of polyol and 50 weight percent of isocyanate.

8. The refrigerant distribution unit as claimed in claim 7, wherein said case has an injection port for injecting said foamable urethane such that said urethane expands in said case in the direction which coincide with the direction in which stator sections of said electric valves are fitted onto the respective bodies of said electric valves.

9. The refrigerant distribution unit as claimed in claim 8, adopted to be positioned at a flat place closer to said indoor units than to said outdoor unit.

10. The refrigerant distribution unit as claimed in claim 9, positioned at a substantially equal distance from said indoor units.

11. In an integrated refrigerant distribution unit for use with a multiplex air-conditioning system capable of providing, through a multiplicity of refrigerant tubes connected therewith, refrigerant from a single outdoor unit to a multiplicity of indoor units, said refrigerant distribution unit including a flow control unit connected with one of said refrigerant tubes for receiving said refrigerant from said outdoor unit and for distributing optimal amounts of refrigerant to a multiplicity of branch tubes connected with said indoor units; and a case made up of two metallic members for enclosing a major portion of said flow control unit, a method of enclosing said major portion of said flow control unit in said case comprising the steps of:

(a) setting up said flow control unit in an expansion jig having the same internal space as that of said case;

(b) injecting a foamable resin in said expansion jig and expanding said resin to fill said space;

(c) mounting, on one of said casing members independently of steps (a) and (b) above, necessary electric components for controlling said flow control units; and (d) mounting said one casing member obtained in step (c) and the other casing member on said major portion of said flow control unit fabricated in step (b).

* * * * *